US010589525B2

(12) United States Patent
Matsuura

(10) Patent No.: US 10,589,525 B2
(45) Date of Patent: Mar. 17, 2020

(54) LIQUID DISCHARGE APPARATUS

(71) Applicant: BROTHER KOGYO KABUSHIKI KAISHA, Nagoya-shi, Aichi-ken (JP)

(72) Inventor: Kazunari Matsuura, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/257,167

(22) Filed: Jan. 25, 2019

(65) Prior Publication Data

US 2019/0299606 A1 Oct. 3, 2019

(30) Foreign Application Priority Data

Mar. 29, 2018 (JP) ..... 2018-064581

(51) Int. Cl.

| | |
|---|---|
| ***B41J 2/045*** | (2006.01) |
| ***B41J 2/175*** | (2006.01) |
| ***B41J 2/14*** | (2006.01) |
| ***B41J 2/145*** | (2006.01) |

(52) U.S. Cl.

CPC ..... *B41J 2/04586* (2013.01); *B41J 2/1404* (2013.01); *B41J 2/145* (2013.01); *B41J 2/17596* (2013.01)

(58) Field of Classification Search

CPC ..... B41J 2/04586; B41J 2/145; B41J 2/1404; B41J 2/17596

See application file for complete search history.

(56) References Cited

U.S. PATENT DOCUMENTS

2008/0231650 A1* 9/2008 Kojima ..... B41J 2/055 347/17

FOREIGN PATENT DOCUMENTS

JP H03184872 A 8/1991

* cited by examiner

*Primary Examiner* — Bradley W Thies

(74) *Attorney, Agent, or Firm* — Scully, Scott, Murphy & Presser, PC

(57) ABSTRACT

There is provided a liquid discharge apparatus including: a liquid discharge head; a first channel communicating with a first communication port; a pump communicating with the first channel; a second channel communicating with the pump; a first switching valve communicating with the second channel; a third channel communicating with the first switching valve; a storage section communicating with the third channel; a fourth channel communicating with the storage section; a second switching valve communicating with the fourth channel; a fifth channel communicating with the second switching valve and the second communication port; and a sixth channel communicating with the first and second switching valves. The first switching valve connects the second channel and the third channel, or connects the second channel and the sixth channel The second switching valve connects the fifth and fourth channels, or connects the fifth and sixth channels.

12 Claims, 14 Drawing Sheets

LIQUID DISCHARGE APPARATUS

CROSS REFERENCE TO RELATED APPLICATION

The present application claims priority from Japanese Patent Application No. 2018-064581 filed on Mar. 29, 2018, the disclosure of which is incorporated herein by reference in its entirety.

BACKGROUND

Field of the Invention

The present disclosure relates to a liquid discharge apparatus including a liquid discharge head provided with nozzles, and a storage section for storing a liquid.

Description of the Related Art

There is known a liquid discharge apparatus having a pump and a switching valve both of which are provided in the channel connecting a liquid discharge head and a liquid tank (storage section). The liquid discharge apparatus is known such that a circulation path including the storage section is formed with an aid of the switching valve, and then, a liquid is circulated along the circulation path by driving the pump.

SUMMARY

The aforementioned liquid discharge apparatus has the storage section in the circulation path. If the liquid in the liquid discharge head (in particular, liquid in the vicinity of nozzles) is in a viscous state or in a state in which components (such as coloring materials) in the liquid are aggregated, and such a liquid is circulated along the circulation path, the viscous liquid or aggregates of the components may enter the storage section as a foreign substance. If the viscous liquid enters the storage section, the viscosity of the liquid in the storage section may be increased. Or, if the aggregates enter the storage section, the aggregates may remain in the storage section. In such a case, when the liquid is discharged from nozzles on the basis of a recording command, the viscous liquid or the aggregates in the storage section is/are supplied to the liquid discharge head, and a discharging failure may occur.

An object of the present disclosure is to provide a liquid discharge apparatus which is capable of suppressing a viscous liquid and aggregates from entering a storage section.

According to an aspect of the present disclosure, there is provided a liquid discharge apparatus, including: a liquid discharge head having: nozzles; a first communication port which communicates with the nozzles; and a second communication port which communicates with the nozzles. The liquid discharge apparatus further including: a first channel having two ends, one of the two ends communicating with the first communication port; a pump communicating with the other of the two ends of the first channel; a second channel having two ends, one of the two ends communicating with the pump; a first switching valve communicating with the other of the two ends of the second channel; a third channel having two ends, one of the two ends communicating with the first switching valve; a storage section configured to store a liquid, and communicating with the other of the two ends of the third channel; a fourth channel having two ends, one of the two ends communicating with the storage section; a second switching valve communicating with the other of the two ends of the fourth channel; a fifth channel having two ends, one of the two ends communicating with the second switching valve and the other of the two ends communicating with the second communication port; and a sixth channel having two ends, one of the two ends communicating with the first switching valve and the other of the two ends communicating with the second switching valve. The first switching valve is switchable to a first state of connecting the second channel and the third channel, and a second state of connecting the second channel and the sixth channel. The second switching valve is switchable to a third state of connecting the fifth channel and the fourth channel, a fourth state of connecting the fifth channel and the sixth channel By adopting the above-described configuration of the channels and the switching valves, it is possible to form a circulation path not including the storage section. With this, even if the liquid in the liquid discharge head (in particular, liquid in the vicinity of the nozzles) is in a viscous state or in a state in which components in the liquid are aggregated, and such a liquid is circulated along the circulation path, it is possible to suppress the viscous liquid or the aggregates from entering the storage section.

DESCRIPTION OF THE EMBODIMENTS

First Embodiment

First, with reference to FIGS. 1 to 6, an explanation will be given about a printer 100 according to the first embodiment of the present disclosure.

Figure 1:
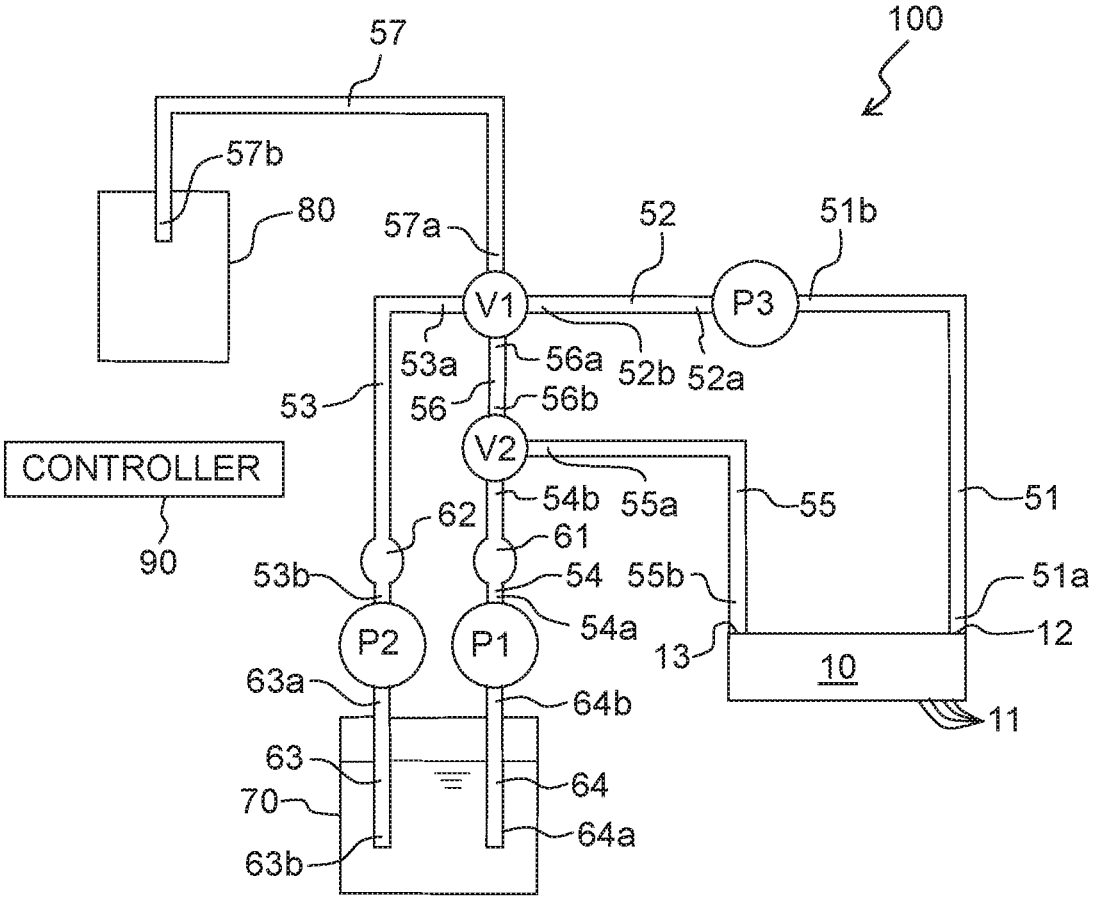
FIG. 1 is an overall configuration diagram of a printer according to the first embodiment.

The printer 100 includes, as depicted in FIG. 1, a head 10, a sub-tank 70, a waste ink tank 80, a supply pump P1, a return pump P2, a circulation pump P3, switching valves V1, V2, and a controller 90. The printer 100 is an example of a "liquid discharge apparatus," the head 10 is an example of a "liquid discharge head," the sub-tank 70 is an example of a "storage section," the waste ink tank 80 is an example of a "collection section," the circulation pump P3 is an example of a "pump," the switching valve V1 is an example of a "first switching valve," and the switching valve V2 is an example of a "second switching valve."

A plurality of nozzles 11 and communication ports 12, 13 are formed in the head 10. The communication port 12 is an example of a "first communication port," and the communication port 13 is an example of a "second communication port."

Figure 2:
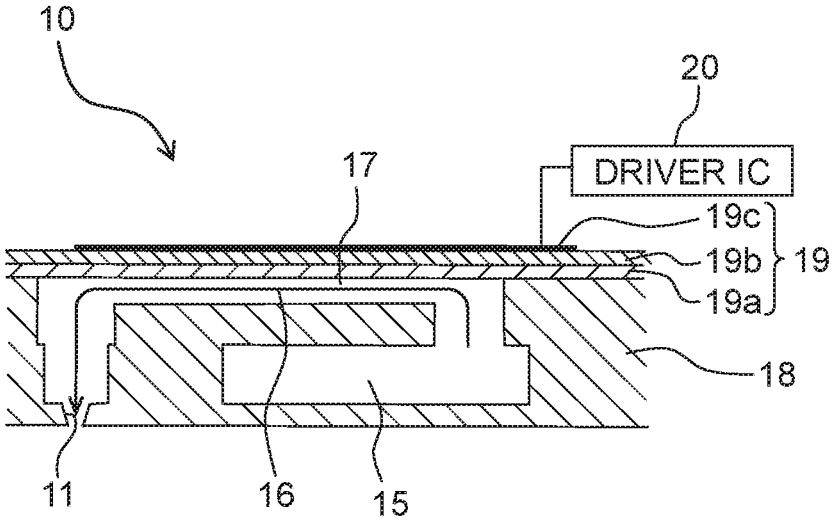
FIG. 2 is a partial cross-sectional view of a head in FIG. 1.

The head 10 includes, as depicted in FIG. 2, a channel unit 18 and an actuator unit 19. On the lower surface of the channel unit 18, the plurality of nozzles 11 are formed. In an area of the upper surface of the channel unit 18, in which the actuator unit 19 is not arranged, the communication ports 12, 13 are formed.

Inside of the channel unit 18, a common channel 15 and a plurality of individual channels 16 are formed. The common channel 15 is a channel common to the plurality of nozzles 11. The individual channel 16 is provided for each of the nozzles 11, and is a channel from an outlet of the common channel 15 via a pressure chamber 17 to one of the nozzles 11. The communication ports 12, 13 communicate with the common channel 15, and communicate with all of the plurality of nozzles 11 via the common channel 15. A plurality of pressure chambers 17, each provided for one of the individual channels 16, are opened in an area of the upper surface of the channel unit 18, in which the actuator unit 19 is arranged.

The actuator unit 19 includes a vibration plate 19*a*, a piezoelectric layer 19*b*, and a plurality of individual electrodes 19*c*. The vibration plate 19*a* is arranged in an area of the upper surface of the channel unit 18, in which the plurality of pressure chambers 17 are opened. The piezoelectric layer 19*b* is arranged on the upper surface of the vibration plate 19*a*. The plurality of individual electrode 19*c* are arranged on the upper surface of the piezoelectric layer 19*b*, and face the plurality of pressure chambers 17, respectively. The plurality of individual electrodes 19*c* are electrically connected to a driver IC 20. A portion of both the vibration plate 19*a* and the piezoelectric layer 19*b*, which is sandwiched by each of the individual electrodes 19*c* and each of the pressure chambers 17, functions as an individual unimorph type actuator for the each of the pressure chambers 17, and is independently deformable in response to the application of a voltage to the respective individual electrodes 19*c* through the driver IC 20. The deformation of the actuator to form a convex toward the pressure chamber 17 reduces the volume of the pressure chamber 17, as a result of which pressure is applied to the ink in the pressure chamber 17 and the ink is discharged from the nozzle 11.

The sub-tank 70 communicates with a main tank (illustration omitted) via a tube, and stores the ink supplied from the main tank. The channel area of the sub-tank 70 (cross sectional area of the cavity in the sub-tank 70 along a horizontal surface) is greater than the area of any channel connecting the sub-tank 70 and the head 10.

The sub-tank 70 and the waste ink tank 80 communicate with the head 10 via the pumps P1 to P3, the switching valves V1, V2, and the tubes defining channels 51 to 57, 63, 64.

The channel 51 has one end 51*a* communicating with the communication port 12 and the other end 51*b* communicating with the circulation pump P3. The channel 52 has one end 52*a* communicating with the circulation pump P3 and the other end 52*b* communicating with the switching valve V1. The channel 53 has one end 53*a* communicating with the switching valve V1 and the other end 53*b* communicating with the return pump P2. The channel 63 has one end 63*a* communicating with the return pump P2 and the other end 63*b* communicating with the sub-tank 70. The channel 64 has one end 64*a* communicating with the sub-tank 70 and the other end 64*b* communicating with the supply pump P1. The channel 54 has one end 54*a* communicating with the supply pump P1 and the other end 54*b* communicating with the switching valve V2. The channel 55 has one end 55*a* communicating with the switching valve V2 and the other end 55*b* communicating with the communication port 13. The channel 56 has one end 56*a* communicating with the switching valve V1 and the other end 56*b* communicating with the switching valve V2. The channel 57 has one end 57*a* communicating with the switching valve V1 and the other end 57*b* communicating with the waste ink tank 80.

A damper 61 is provided between the one end 54*a* and the other end 54*b* of the channel 54. A damper 62 is provided between the one end 53*a* and the other end 53*b* of the channel 53. The channel area of the damper 61 is greater than the channel area of the portion of the channel 54 which excludes the damper 61. The channel area of the damper 62 is greater than the channel area of the portion of the channel 53 which excludes the damper 62. By the damper 61, the pressure fluctuation associated with the driving of the supply pump P1 is reduced. By the damper 62, the pressure fluctuation associated with the driving of the return pump P2 is reduced.

Here, the channel 51 is an example of the "first channel," the channel 52 is an example of the "second channel," the channels 53, 63 are an example of the "third channel," the channels 54, 64 are an example of the "fourth channel," the channel 55 is an example of the "fifth channel," the channel 56 is an example of the "sixth channel," and the channel 57 is an example of the "seventh channel (first aspect)."

The switching valve V1 may be switched to a first state (FIG. 1) of connecting the channel 52 and the channel 53 and a second state (FIG. 5A) of connecting the channel 52 and the channel 56. The switching valve V2 may be switched to a third state (FIG. 1) of connecting the channel 55 and the channel 54, a fourth state (FIG. 5A) of connecting the channel 55 and the channel 56, and a fifth state (FIG. 6A) of stopping the outflow of an ink from the one end 55*a* of the channel 55. Furthermore, the switching valve V1 may also be switched to a sixth state (FIG. 5B) of connecting the channel 52 and the channel 57.

Figure 3:
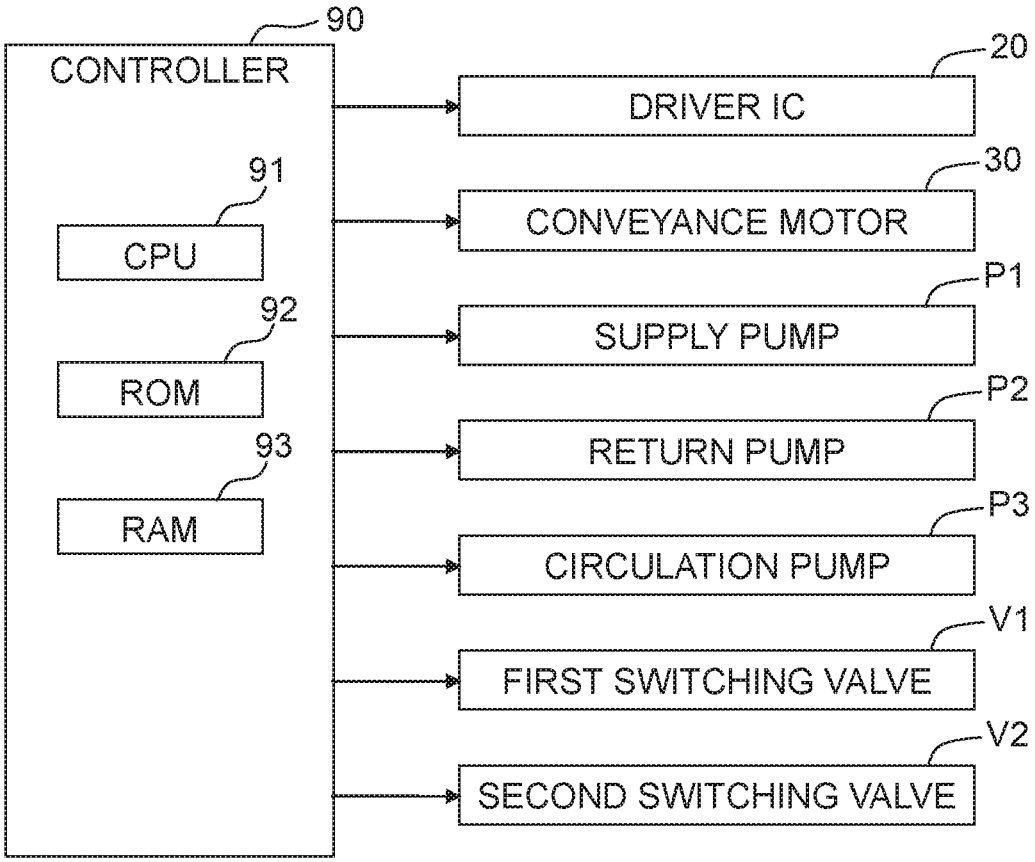
FIG. 3 is a block diagram depicting an electrical configuration of the printer in FIG. 1.

The controller 90 includes, as depicted in FIG. 3, a CPU (Central Processing Unit) 91, a ROM (Read Only Memory) 92, and a RAM (Random Access Memory) 93. The controller 90 is electrically connected with the driver IC 20, a conveyance motor 30, the supply pump P1, the return pump P2, the circulation pump P3, and the switching valves V1, V2. By the conveyance motor 30, a conveyance mechanism (illustration omitted) is driven and a paper is conveyed.

Based on a recording command transmitted from an external device (for example, PC connected to the printer 100), the CPU 91 controls the conveyance motor 30 to cause a paper to be conveyed by the conveyance mechanism, and controls the driver IC 20 to cause an ink to be selectively discharged from the plurality of nozzles 11 by an actuator (recording processing). With this, an image is recorded on the paper. Further, the CPU 91 executes short path circulation processing, long path circulation processing, purge processing, collection processing, etc., as will be detailed later. The ROM 92 stores the program executed by the CPU 91, various fixed data, etc. The RAM 93 temporarily stores the data (such as image data) needed by the CPU 91 at the time of execution of the program.

Figure 4:
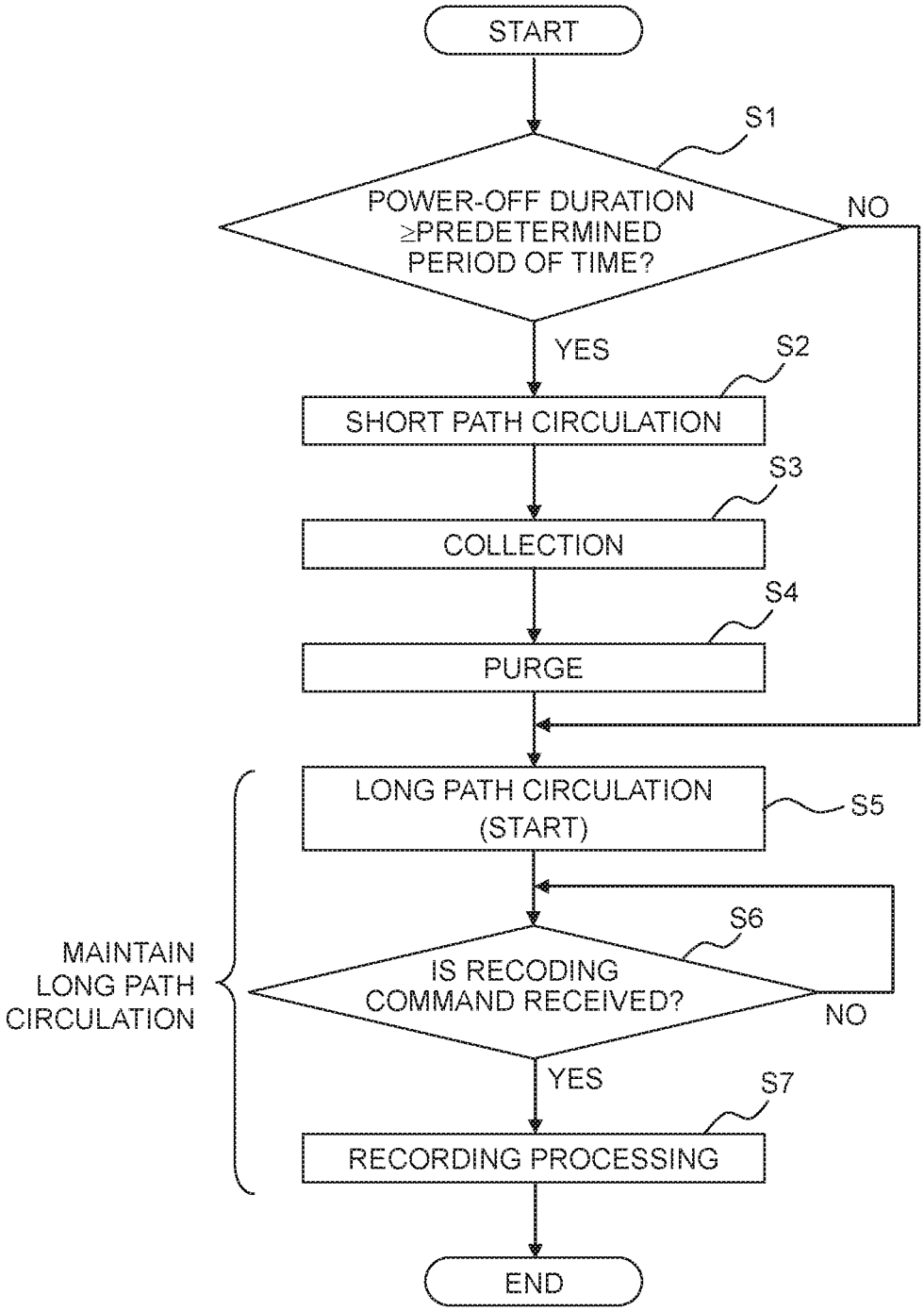
FIG. 4 is a flow chart depicting the control content executed by a controller of the printer in FIG. 1.

Next, with reference to FIG. 4, an explanation will be given about the content of the control executed by the controller 90 (CPU 91).

When the power source of the printer 100 is turned on, the CPU 91 first determines whether the power-off duration of the printer 100 (namely, the duration from the point of time when the power source of the printer 100 was turned off at the last time to the point of time when the power source of the printer 100 was turned on this time) is at least a predetermined period of time (S1). The predetermined period of time is stored in the ROM 92. Further, the CPU 91 causes the point of time when the power source of the printer 100 was turned on and the point of time when the power source of the printer 100 was turned off to be stored in the RAM 93. In the step S1, the CPU 91 obtains from the RAM 93 the point of time when the power source of the printer 100 was turned off at the last time and the point of time when the power source of the printer 100 was turned on this time, and calculates the power-off duration. Then, the CPU 91 obtains the predetermined period of time from the RAM 93, and determines whether the power-off duration thus calculated is at least the predetermined period of time.

If the power-off duration of the printer 100 is less than the predetermined period of time (S1: NO), the CPU 91 advances processing to the step S5 which will be described later.

If the power-off duration of the printer 100 is at least the predetermined period of time (S1: YES), the CPU 91 executes short path circulation processing (S2). The short path circulation processing is an example of the "circulation processing."

Figure 5A:
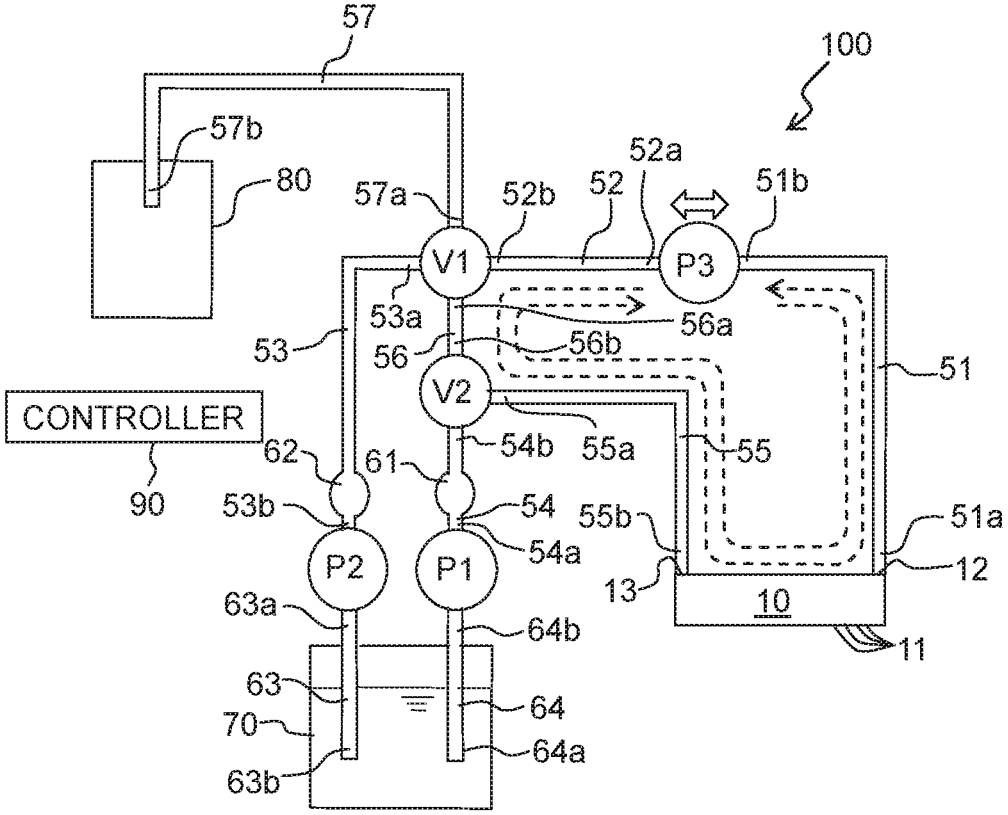
FIG. 5A is a diagram depicting short path circulation processing according to the first embodiment.

In the short path circulation processing (S2), the CPU91 first sets the switching valve V1 to be in the second state and sets the switching valve V2 to be in the fourth state, as depicted in FIG. 5A. Subsequently, the CPU 91 drives the circulation pump P3 while maintaining the states of the switching valves V1, V2. With this, an ink is circulated along a short path (a relatively short annular path not including the sub-tank 70). In this embodiment, the short path is a path passing through the channels 51, 52, 56, 55 and the common channel 15 of the head 10.

The circulation pump P3 is a bidirectional pump. The CPU 91 switches the rotational direction of the circulation pump P3 every fixed period of time during the execution of the short path circulation processing (S2) to switch the direction of the ink flow.

After the short path circulation processing (S2), the CPU 91 performs collection processing (S3).

Figure 5B:
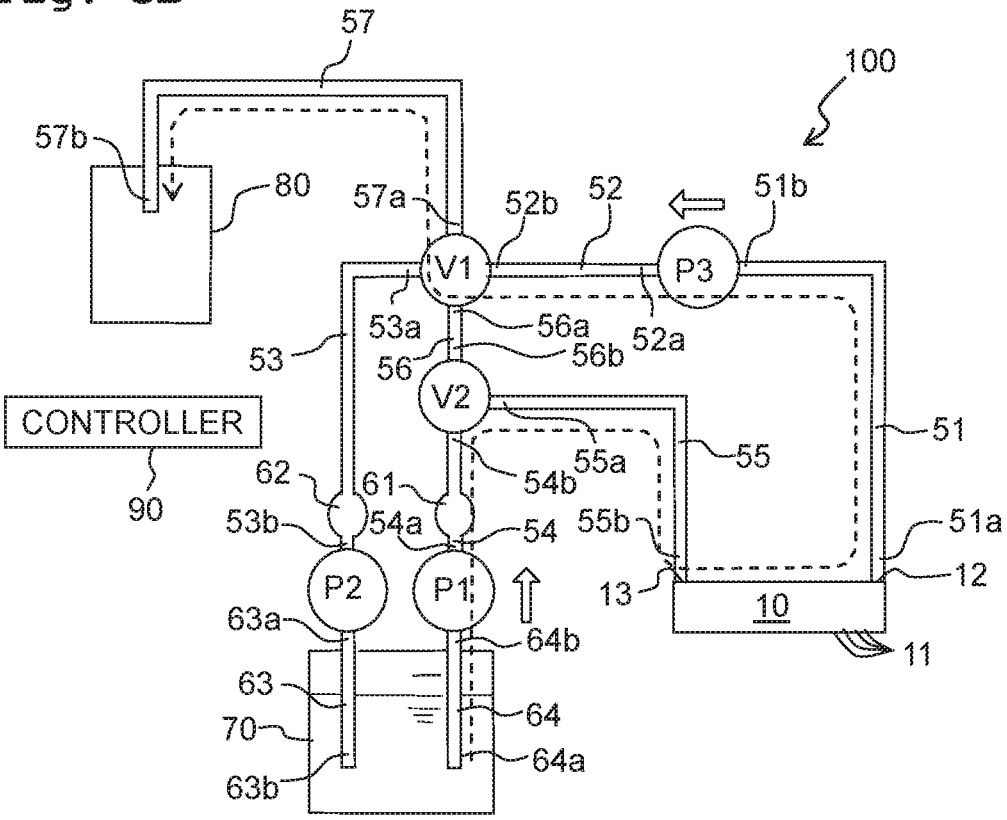
FIG. 5B is a diagram depicting collection processing according to the first embodiment.

In the collection processing (S3), the CPU 91 first sets the switching valve V1 to be in the sixth state and sets the switching valve V2 to be in the third state, as depicted in FIG. 5B. Subsequently, the CPU 91 drives the supply pump P1 and the circulation pump P3 while maintaining the states of the switching valves V1, V2. With this, there is formed a flow of the ink which flows from the sub-tank 70 via the channels 64, 54, 55 and the communication port 13 to the common channel 15 of the head 10, and further from the common channel 15 via the communication port 12 and the channels 51, 52, 57 to the waste ink tank 80. The ink which is present in the channels 64, 54, 55, the common channel 15, and the channels 51, 52, 57 at the start of the collection processing (S3) is collected into the waste ink tank 80.

After the collection processing (S3), the CPU 91 executes purge processing (S4).

Figure 6A:
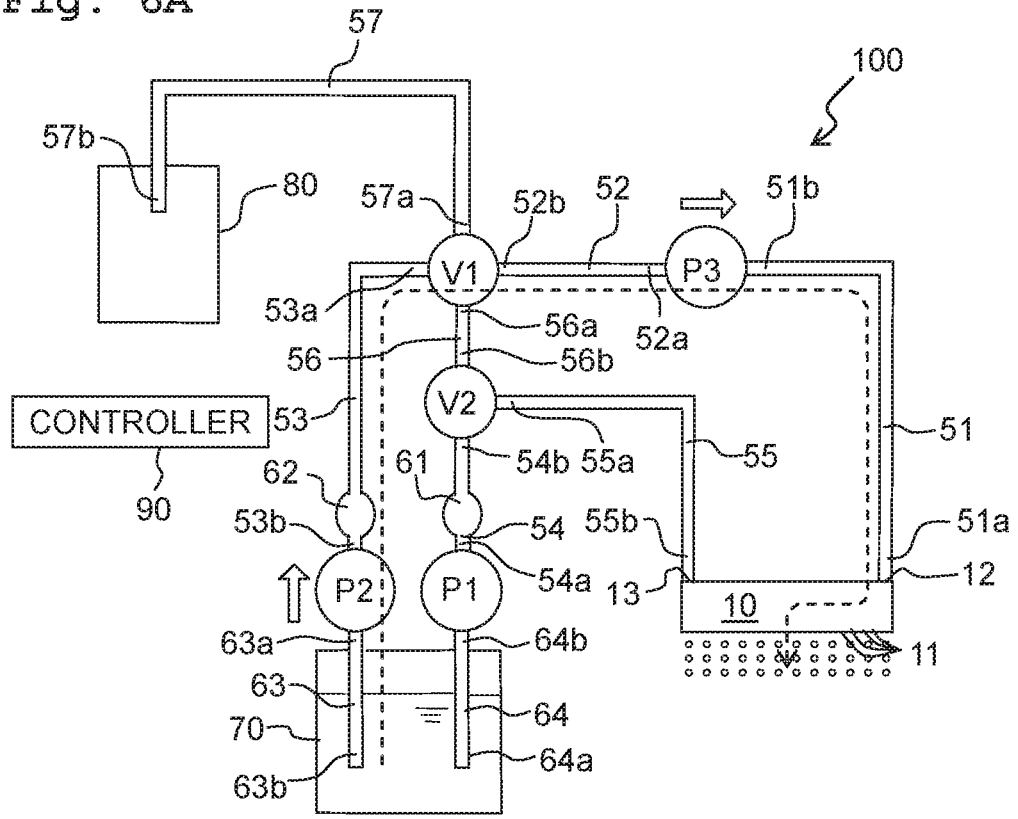
FIG. 6A is a diagram depicting purge processing according to the first embodiment.

In the purge processing (S4), the CPU 91 first sets the switching valve V1 to be in the first state and sets the switching valve V2 to be in the fifth state, as depicted in FIG. 6A. Subsequently, the CPU 91 drives the return pump P2 and the circulation pump P3 while maintaining the states of the switching valves V1, V2. With this, the ink in the sub-tank 70 is pressure-fed to the common channel 15 of the head 10 via the channels 63, 53, 52, 51 and the communication port 12, and the ink is discharged from all the nozzles 11 of the head 10.

After the purge processing (S4) or if the power-off duration of the printer 100 is less than the predetermined period of time (S1: NO), the CPU 91 starts long path circulation processing (S5). The long path circulation processing is an example of the "another circulation processing."

Figure 6B:
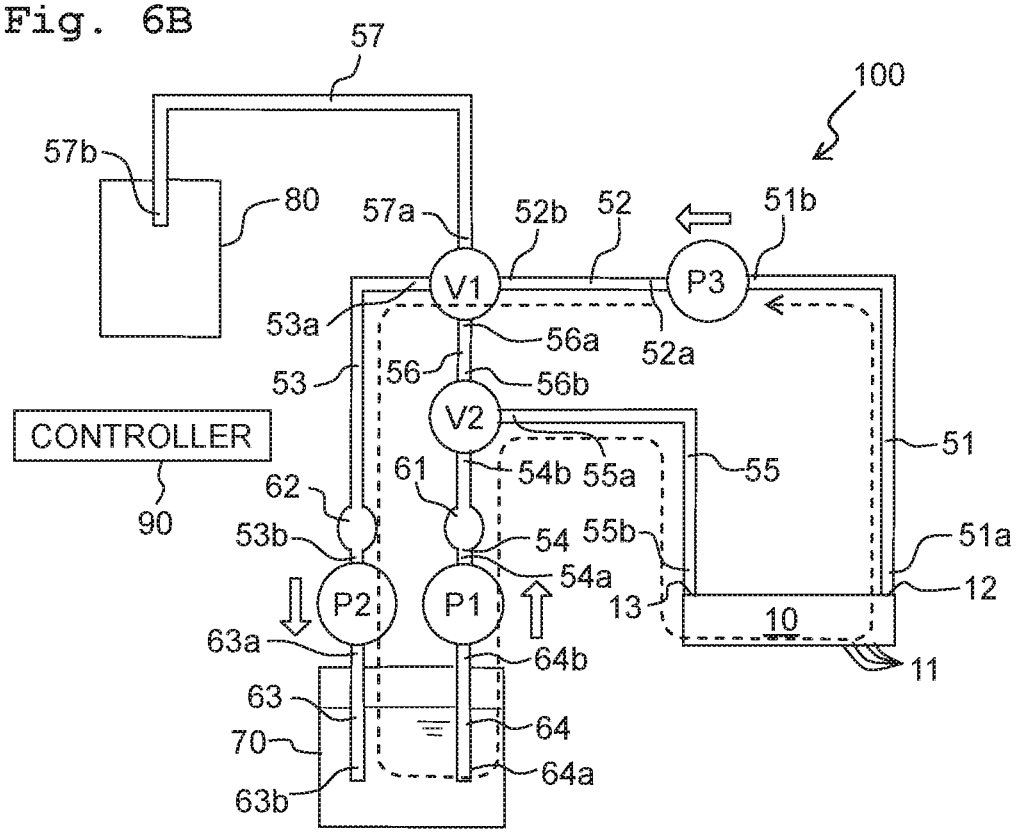
FIG. 6B is a diagram depicting long path circulation processing according to the first embodiment.

In the long path circulation processing (S5), the CPU 91 first sets the switching valve V1 to be in the first state and sets the switching valve V2 to be in the third state, as depicted in FIG. 6B. Subsequently, the CPU 91 drives the supply pump P1, the return pump P2 and the circulation pump P3 while maintaining the states of the switching valves V1, V2. With this, an ink is circulated along a long path (which is a relatively long annular path including the sub-tank 70, and is a path longer than the short path and larger in volume than the short path). In this embodiment, the long path is a path which passes through the channels 51, 52, 53, 63, the sub-tank 70, the channel 64, 54, 55, and the common channel 15 of the head 10.

In the long path circulation processing (S5), the CPU 91 adjusts the rotational speed of the pumps P1 to P3, thereby an ink being circulated at a smaller speed than the speed for circulating the ink in the short path circulation processing (S2).

After starting the long path circulation processing at the step S5, the CPU 91 executes the following processing without ending the long path circulation processing.

After the step S5, the CPU 91 determines whether a recording command is received for an external device (S6). If no recording command is received (S6: NO), the CPU 91 repeats the processing of the step S6.

If a recording command is received (S6: YES), the CPU 91 executes recording processing (S7).

In the recording processing (S7), the CPU 91, as described above, controls the conveyance motor 30 on the basis of the recording command to cause a paper to be conveyed by the conveyance mechanism, and controls the driver IC 20 to cause an ink to be selectively discharged from the plurality of nozzles 11 by the actuator.

Even during the execution of the recording processing (S7), execution of the long path circulation processing (S5) is maintained.

As described above, by using the configuration of the channels and the switching valves in this embodiment, it is possible to form a circulation path not including the sub-tank 70 (FIG. 5A). With this, even if the ink in the head 10 (in particular, ink in the vicinity of the nozzles 11) is in a viscous state or in a state in which components (such as coloring materials) are aggregated, and such an ink is circulated along the circulation path, it is possible to suppress the viscous ink or the aggregates from entering the sub-tank 70.

The controller 90 is configured to set the switching valve V1 to be in the second state and set the switching valve V2 to be in the fourth state, and then, drive the circulation pump P3 to execute the short path circulation processing (S2) for circulating an ink (FIG. 5A). According to this configuration, a relatively short circulation path not including the sub-tank 70 is formed with the aid of the switching valves V1, V2, and the ink is circulated along the circulation path, so that it is possible to reduce power consumption pertaining to the driving of the circulation pump P3.

After the short path circulation processing (S2), the controller 90 is configured to set the switching valve V1 to be in the first state and set the switching valve V2 to be in the fifth state, and then, drive the circulation pump P3 to execute purge processing (S4) for discharging an ink from the nozzles 11 (FIG. 6A). The ink discharge amount in the purge processing is proportional to the length of the circulation path. In the above configuration, the purge processing is executed after the circulation processing is performed in the relatively short circulation path, so that it is possible to reduce the ink discharge amount in the purge processing.

After the short path circulation processing (S2), the controller 90 is configured to execute collection processing (S3) prior to the purge processing (S4). In the collection processing (S3), the controller 90 is configured to set the switching valve V1 to be in the sixth state and set the switching valve V2 to be in the third state, and then, drive the circulation pump P3 to collect an ink into the waste ink tank 80 via the channel 52 to the channel 57. According to this configuration, prior to the purge processing (S4), the viscous ink or aggregates which may be present in the channels 64, 54, 55 is/are moved in a direction toward the waste ink tank 80 via the head 10, the channel 51, the channel 52 and the channel 57. The viscous ink or aggregates which may be present in the channel 64, 54, 55 is/are collected into the waste ink tank 80, or is/are discharged by the purge processing (S4). With this, a discharging failure can be prevented.

During the execution of the recording processing (S7), the controller 90 is configured to set the switching valve V1 to be in the first state and set the switching valve V2 to be in the third state, and then, drive the circulation pump P3 to execute the long path circulation processing (S5) for circulating an ink. According to this configuration, the circulation pump P3 is used not only for the short path circulation processing (S2) with a path not including the sub-tank 70, but also for the long path circulation processing (S5) with a path including the sub-tank 70. In such a case, cost can be reduced as compared with a case in which a pump is provided for each circulation processing.

After the execution of the purge processing (S4), the controller 90 is configured to execute the long path circulation processing (S5). According to this configuration, in the short path circulation processing (S2), an ink is circulated along the path not including the sub-tank 70, and a viscous ink or aggregates is/are dispersed or dissolved. Subsequently, the purge processing (S4) is performed, and the resulting ink is discharged from the nozzles 11. Further subsequently, in the long path circulation processing (S5), the ink is circulated along the path including the sub-tank 70. With this, it is possible to further reliably suppress a viscous ink or aggregates from entering the sub-tank 70.

In the short circulation processing (S2), the controller 90 circulates the ink at a speed greater than the speed for circulating the ink in the long path circulation processing (S5). According to this configuration, in the short circulation processing (S2), the ink is circulated at a relatively great speed, thereby it is possible to further reliably disperse or dissolve a viscous ink or aggregates.

If the power source of the printer 100 is turned on after the power-off duration of the printer 100 becomes at least the predetermined period of time, the controller 90 is 0101 the short path circulation processing (S1: YES→S2). As the power-off duration of the printer 100 becomes longer, it is increasingly possible that the viscosity of the ink in the head 10 increases and the ink is solidified or plenty of aggregates are generated in the head 10, due to volatilization of a solvent, etc. When the power-off duration is short, circulating the ink easily disperses or dissolves a viscous ink or aggregates in the head 10. However, when the power-off duration of the printer 100 is long (becomes at least the predetermined period of time), the solid matters formed by solidification of the ink in the head 10 or the plenty of aggregates generated in the head 10 are difficult to be dispersed or dissolved even if the ink is circulated. Consequently, when the power-off duration of the printer 100 is long, if a liquid is circulated along the path including the sub-tank 70, the solid matters or the plenty of aggregates in the head 10 may enter the sub-tank 70. In such a case, when an ink is discharged from the nozzles 11 on the basis of a recording command, the solid matters and the plenty of aggregates in the sub-tank 70 are supplied to the head 10, thereby a problem of causing a discharging failure may be significantly increased. This problem can be solved by the above-described configuration.

Note that even if the nozzle is sealed with a cap during the power-off duration of the printer 100, a solvent is volatilized in the cap. Consequently, in such a case as well, when the power-off duration of the printer 100 becomes long, the problem of causing solidification of an ink or plenty of aggregates as described above may occur.

During the execution of the short path circulation processing (S2), the controller 90 is configured to switch the direction of the ink flow caused by the driving of the circulation pump P3 (FIG. 5A). According to this configuration, a viscous ink or aggregates is/are easily dispersed or dissolved.

The damper 61 is provided for the channel 54, and the damper 62 is provided for the channel 53. If the ink in the liquid discharge head (in particular, ink in the vicinity of the nozzles) is in a viscous state or in a state in which components in the ink are aggregated, and such an ink is circulated along the circulation path including the dampers 61, 62, the viscous ink or the aggregates of the components may enter the dampers 61, 62 as a foreign substance. If the viscous ink enters the dampers 61, 62, the viscosity of the ink in the dampers 61, 62 may be increased. Further, if the aggregates enter the dampers 61, 62, the aggregates may remain in the dampers 61, 62. In such cases, when an ink is discharged from the nozzles 11 on the basis of a recording command, the viscous ink or the aggregates in the dampers 61, 62 may be supplied to the head 10 and cause a discharging failure. According to the above configuration, it is possible to form a circulation path not including the dampers 61, 62 by devising the configuration of the channels and the switching valves (FIG. 5A). With this, the problem as above can be suppressed.

Second Embodiment

Next, with reference to FIGS. 7 to 9, an explanation will be given about a printer 200 according to the second embodiment of the present disclosure. In the following, the same constituting elements as those of the first embodiment are denoted by the same reference numerals, and an explanation therefor is properly omitted.

Figure 7:
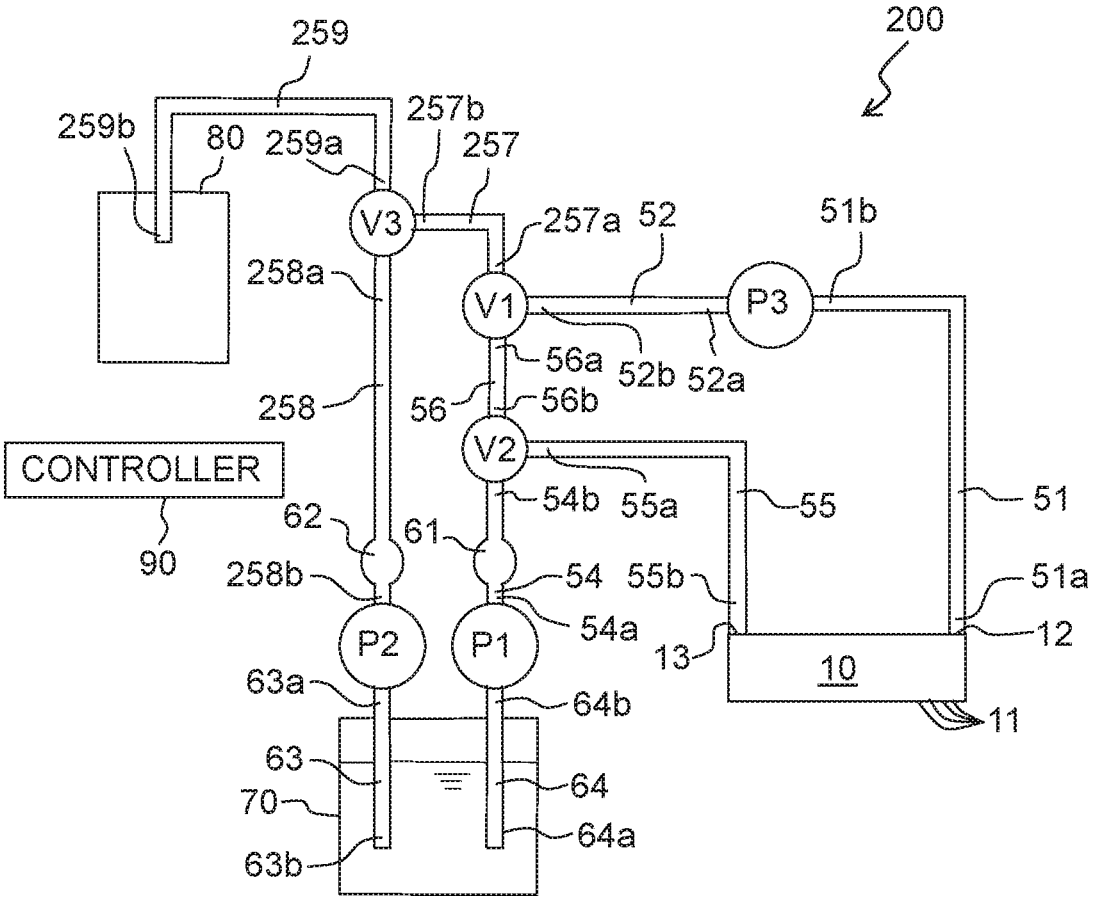
FIG. 7 is an overall configuration diagram of a printer according to the second embodiment.

As depicted in FIG. 7, the printer 200 differs from the printer 100 (FIG. 1) of the first embodiment in terms of the configuration of the channel connecting the switching valve V1 and the waste ink tank 80, the configuration of the channel connecting the switching valve V1 and the sub-tank 70 via the return pump P2, and the addition of a switching valve V3. The switching valve V3 is an example of the "third switching valve."

As a channel connecting the switching valve V1 and the waste ink tank 80, the channel 57 is provided in the first embodiment. In contrast, in this embodiment, channels 257, 259 are provided as a channel connecting the switching valve V1 and the waste ink tank 80. As a channel connecting the switching valve V1 and the sub-tank 70 via the return pump P2, the channels 53, 63 are provided in the first embodiment. In contrast, in this embodiment, the channels 257, 258, 63 are provided as a channel connecting the switching valve V1 and the sub-tank 70 via the return pump P2. The channel 257 communicates with the channels 258, 259, respectively via the switching valve V3.

The channel 257 has one end 257*a* communicating with the switching valve V1 and the other end 257*b* communicating with the switching valve V3. The channel 258 has one end 258*a* communicating with the switching valve V3 and the other end 258*b* communicating with the return pump P2. The channel 259 has one end 259*a* communicating with the switching valve V3 and the other end 259*b* communicating with the waste ink tank 80.

The damper 62 is provided between the one end 258*a* and the other end 258*b* of the channel 258. The channel area of the damper 62 is greater than the channel area of the portion of the channel 258 which excludes the damper 62.

Here, the channel 257 is an example of the "seventh channel (second aspect)," the channel 258 is an example of the "eighth channel (second aspect)," the channels 257, 258 are an example of the "third channel (second aspect)." The channel 259 is an example of the "ninth channel."

Figure 8A:
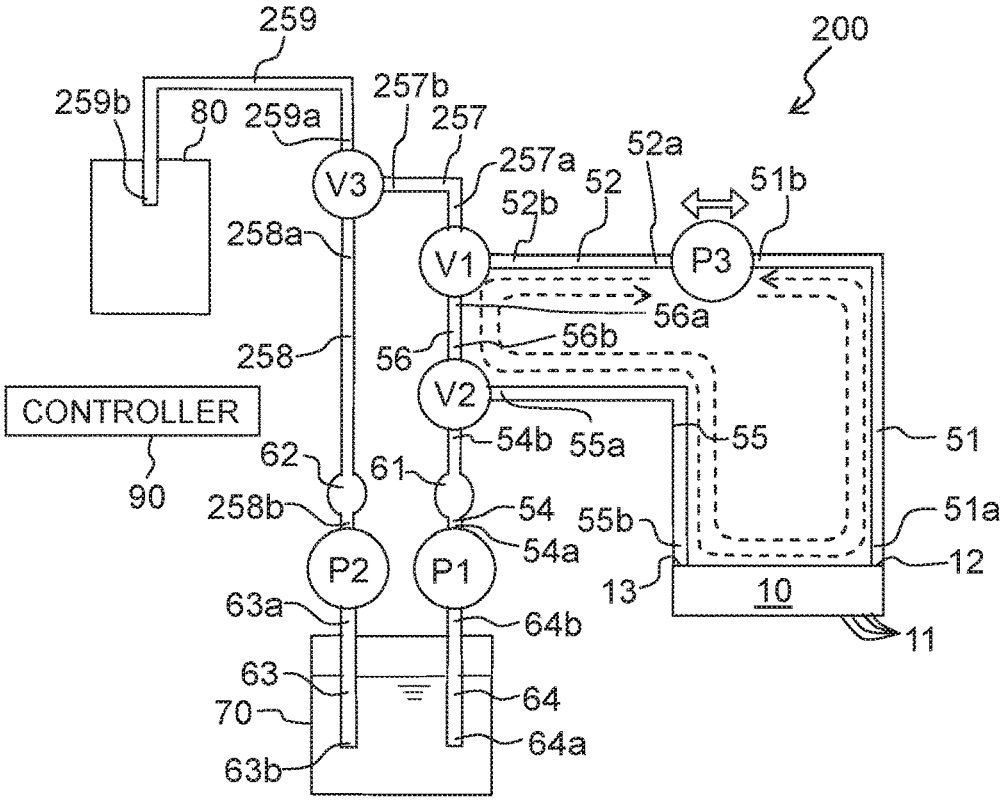
FIG. 8A is a diagram depicting short path circulation processing according to the second embodiment.

The switching valve V1 may be switched to the first state of connecting the channel 52 and the channel 257 (FIG. 7) and the second state of connecting the channel 52 and the channel 56 (FIG. 8A). The switching valve V3 may be switched to the sixth state of connecting the channel 257 and the channel 258 (FIG. 7) and the seventh state of connecting the channel 257 and the channel 259 (FIG. 8B).

In the short path circulation processing (S2), the CPU 91 first sets the switching valve V1 to be in the second state and sets the switching valve V2 to be in the fourth state, as depicted in FIG. 8A. Subsequently, the CPU 91 drives the circulation pump P3 while maintaining the states of the switching valves V1, V2. With this, an ink is circulated along the short path.

Figure 8B:
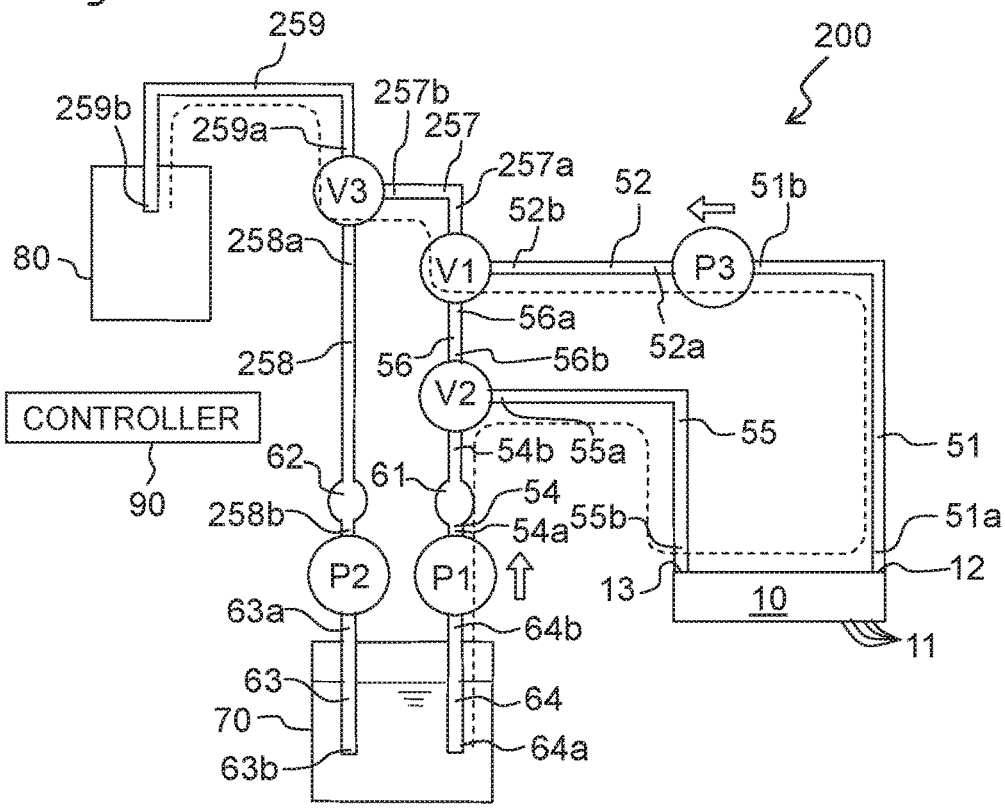
FIG. 8B is a diagram depicting collection processing according to the second embodiment.

In the collection processing (S3), the CPU 91 first sets the switching valve V1 to be in the first state, sets the switching valve V2 to be in the third state, and sets the switching valve V3 to be in the seventh state, as depicted in FIG. 8B. Subsequently, the CPU 91 drives the supply pump P1 and the circulation pump P3 while maintaining the states of the switching valves V1 to V3. With this, there is formed a flow of the ink which flows from the sub-tank 70 via the channels 64, 54, 55 and the communication port 13 to the common channel 15 of the head 10, and further from the common channel 15 via the communication port 12 and the channels 51, 52, 257, 259 to the waste ink tank 80. The ink which is present in the channels 64, 54, 55, the common channel 15, and the channels 51, 52, 257, 259 at the start of the collection processing (S3) is collected into the waste ink tank 80.

Figure 9A:
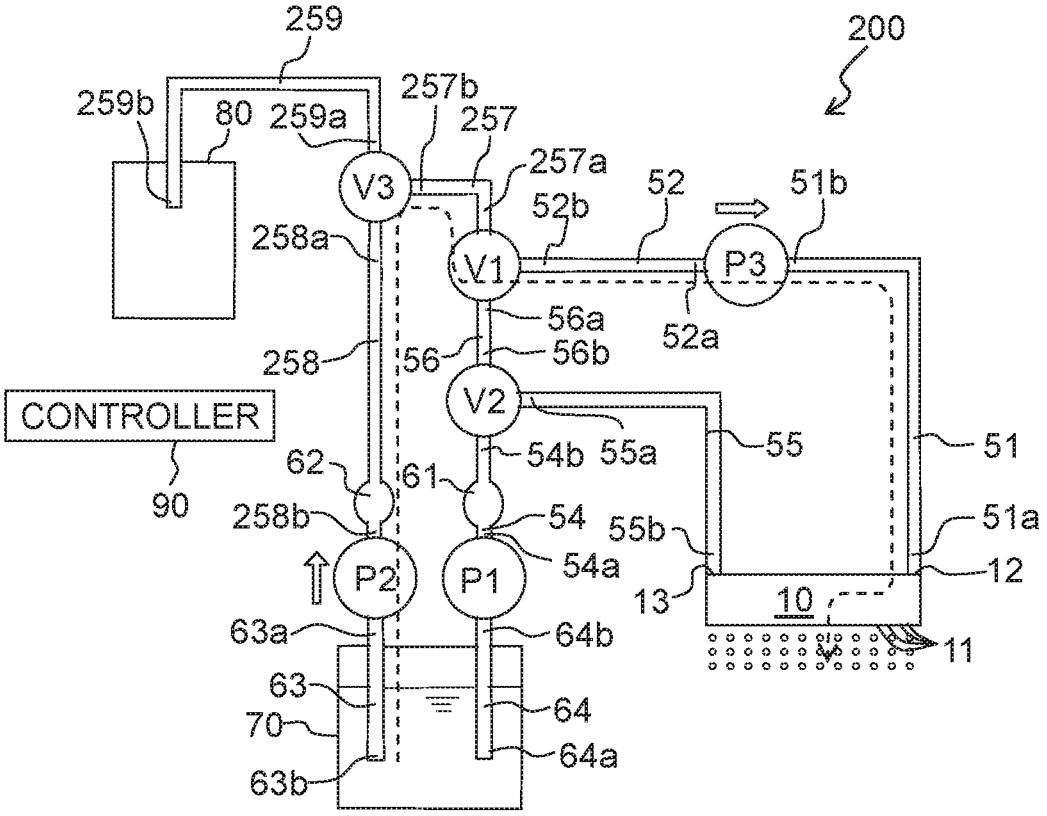
FIG. 9A is a diagram depicting purge processing according to the second embodiment.

In the purge processing (S4), the CPU 91 first sets the switching valve V1 to be in the first state, sets the switching valve V2 to be in the fifth state, and sets the switching valve V3 to be in the sixth state, as depicted in FIG. 9A. Subsequently, the UPC 91 drives the return pump P2 and the circulation pump P3 while maintaining the states of the switching valves V1 to V3. With this, the ink in the sub-tank 70 is pressure-fed to the common channel 15 of the head 10 via the channels 63, 258, 257, 52, 51 and the communication port 12, and the ink is discharged from all the nozzles 11 of the head 10.

Figure 9B:
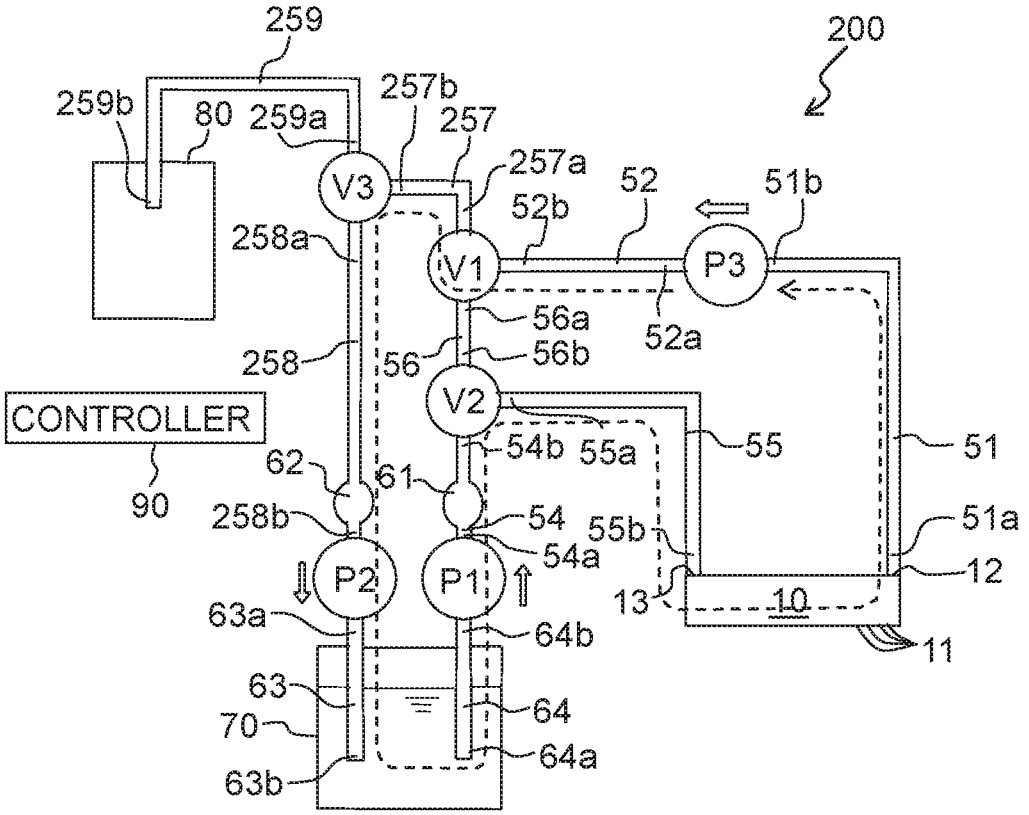
FIG. 9B is a diagram depicting long path circulation processing according to the second embodiment.

In the long path circulation processing (S5), the CPU 91 first sets the switching valve V1 to be in the first state, sets the switching valve V2 to be in the third state, and sets the switching valve V3 to be in the sixth state, as depicted in FIG. 9B. Subsequently, the CPU 91 drives the supply pump P1, the return pump V2 and the circulation pump P3 while maintaining the states of the switching V1 to V3. With this, an ink is circulated along the long path. In this embodiment, the long path is a path which passes through the channels 51, 52, 257, 258, 63, the sub-tank 70, the channels 64, 54, 55, and the common channel 15 of the head 10.

As described above, according to this embodiment, in the collection processing (S3), the controller 90 is configured to set the switching valve V1 to be the first state, set the switching valve V2 to be in the third state, and set the switching valve V3 to be in the seventh state, and then, drive the circulation pump P3 to collect an ink into the waste ink tank 80 via the channel 257 to the channel 259. According to this configuration, prior to the purge processing (S4), the viscous ink or the aggregates which may be present in the channels 64, 54, 55 is/are moved in a direction toward the waste ink tank 80 via the head 10, the channel 51, the channel 52, the channel 257 and the channel 259. The viscous ink or the aggregates which may be present in the channels 64, 54, 55 is/are collected into the waste ink tank 80, or is/are discharged by the purge processing (S4). With this, a discharging failure can be prevented.

Third Embodiment

Next, with reference to FIGS. 10 to 14, an explanation will be given about a printer 300 according to the third embodiment of the present disclosure. In the following, the same constituting elements as those of the first embodiment are denoted by the same reference numerals, and an explanation therefor is properly omitted.

Figure 10:
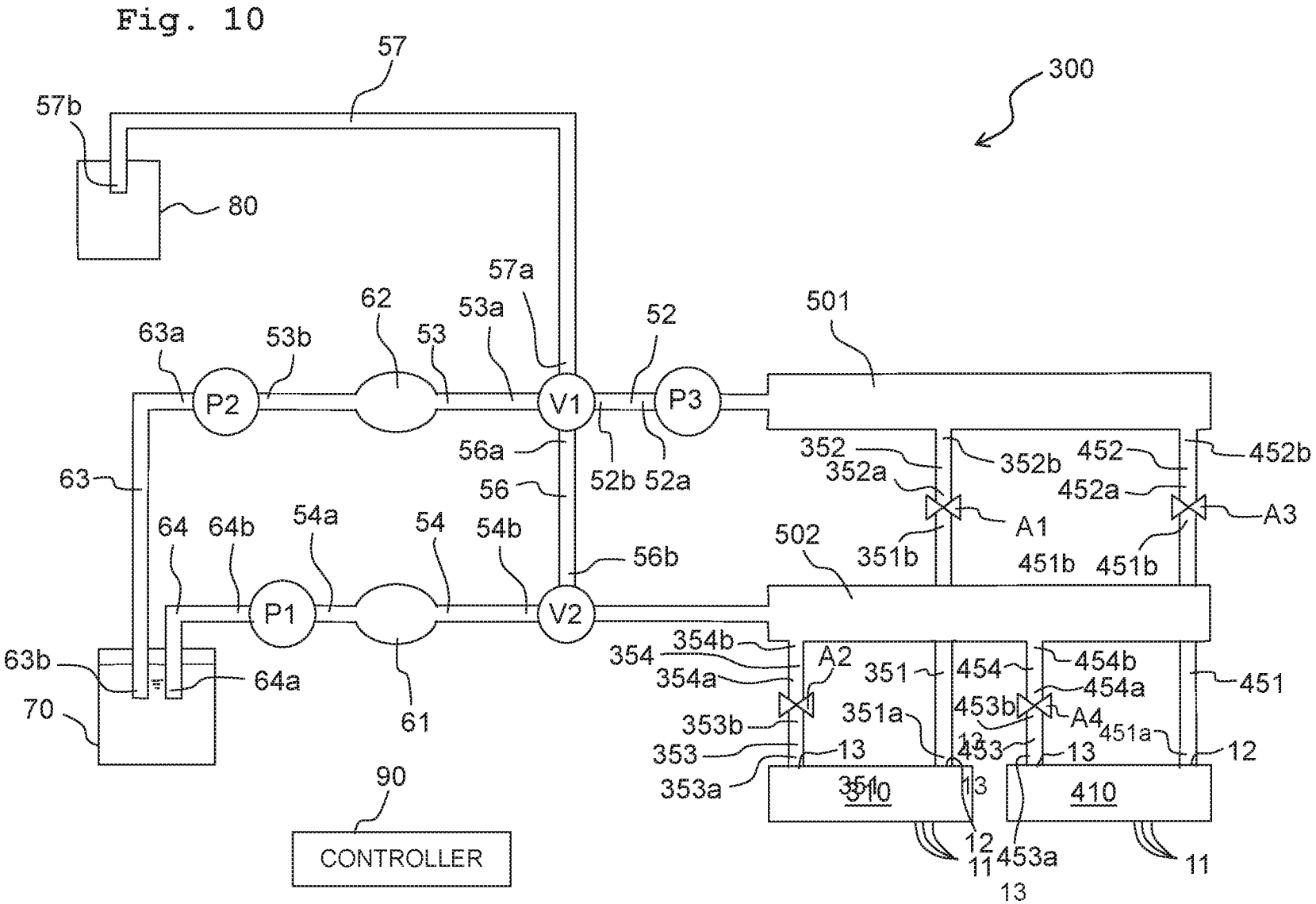
FIG. 10 is an overall configuration diagram of a printer according to the third embodiment.

As depicted in FIG. 10, the printer 300 differs from the printer 100 (FIG. 1) of the first embodiment in terms of the inclusion of two heads 310, 410, the configuration of the channel from the communication port 12 of each of the heads 310, 410 to the circulation pump P3, the configuration of the channel from the communication port 13 of each of the heads 310, 410 to the switching valve V2, and the addition of opening/closing valves A1 to A4. The opening/closing valve A1 is an example of the "first opening/closing valve," the opening/closing valve A2 is an example of the "second opening/closing valve," the opening/closing valve A3 is an example of the "third opening/closing valve," and the opening/closing valve A4 is an example of the "fourth opening/closing valve."

Each of the heads 310, 410 has the same configuration as that of the head 10 in the first embodiment. The head 310 is an example of the "liquid discharge head," and the head 410 is an example of the "liquid discharge head A (another liquid discharge head)." The nozzles 11 of the head 410 are an example of the "nozzles A (other nozzles)," the communication port 12 of the head 410 is an example of the "first communication port A (another first communication port)," and the communication port 13 of the head 410 is an example of the "second communication port A (another second communication port)."

As the channels from the communication port 12 of each of the heads 310, 410 to the circulation pump P3, the channels 351, 352, 451, 452, 501 are provided in this embodiment. As the channels from the communication port 13 of each of the heads 310, 410 to the switching valve V2, the channels 353, 354, 453, 454, 502 are provided in this embodiment.

The channel 351 has one end 351*a* communicating with the communication port 12 of the head 310 and the other end 351*b* communicating with the opening/closing valve A1. The channel 352 has one end 352*a* communicating with the opening/closing valve A1 and the other end 352*b* communicating with the channel 501. The channel 353 has one end 353*a* communicating with the communication port 13 of the head 310 and the other end 353*b* communicating with the opening/closing valve A2. The channel 354 has one end 354*a* communicating with the opening/closing valve A2 and the other end 354*b* communicating with the channel 502.

The channel 451 has one end 451*a* communicating with the communication port 12 of the head 410 and the other end 451*b* communicating with the opening/closing valve A3. The channel 452 has one end 452*a* communicating with the opening/closing valve A3 and the other end 452*b* communicating with the channel 501. The channel 453 has one end 453*a* communicating with the communication port 13 of the head 410 and the other end 453*b* communicating with the opening/closing valve A4. The channel 454 has one end 454*a* communicating with the opening/closing valve A4 and the other end 454*b* communicating with the channel 502.

The channel 501 has an end communicating with the other end 352*b*, an end communicating with the other end 452*b*, and an end communicating with the circulation pump P3. The channel 502 has an end communicating with the other end 354*b*, an end communicating with the other end 454*b*, and an end communicating with the switching valve V2.

Here, the channel 501 is an example of the "first common channel," and the channel 502 is an example of the "second common channel." Each of the channels 501, 502 is a channel common to the two heads 310, 410. Namely, the channel 501 communicates with the head 310 via the channels 351, 352, and communicates with the head 410 via the channels 451, 452. The channel 502 communicates with the head 310 via the channels 353, 354, and communicates with the head 410 via the channels 453, 454.

The channel 351 is an example of the "first individual channel," the channel 352 is an example of the "second individual channel," and the channels 351, 352, 501 are an example of the "first channel (third aspect)." The channel 353 is an example of the "third individual channel," the channel 354 is an example of the "fourth individual channel," and the channels 353, 354, 502 are an example of the "fifth channel (third aspect)."

The channel 451 is an example of the "first individual channel A (another first individual channel)," the channel 452 is an example of the "second individual channel A (another second individual channel)." The channel 453 is an example of the "third individual channel A (another third individual channel)," and the channel 454 is an example of the "fourth individual channel A (another fourth individual channel)."

Figure 11:
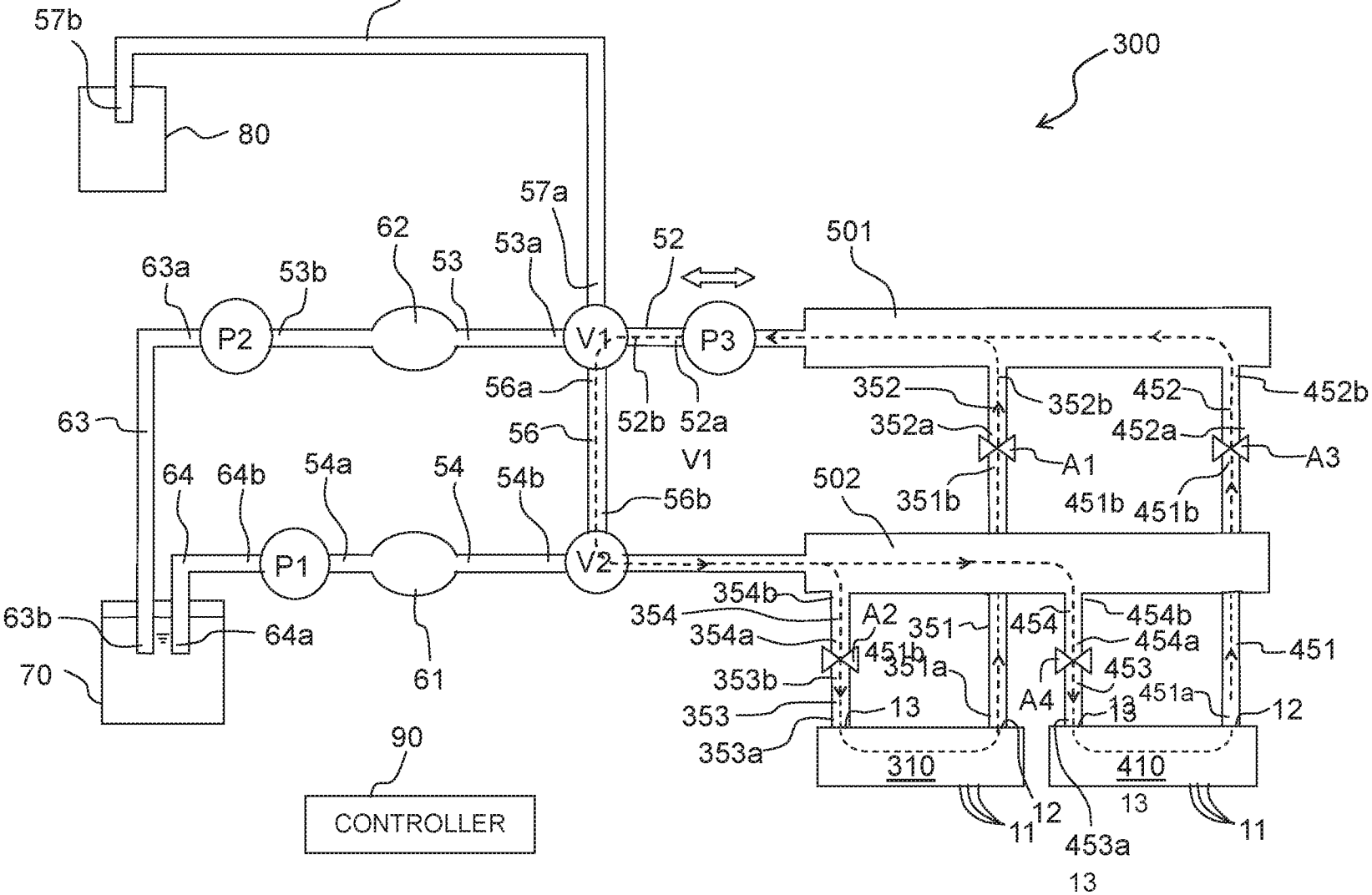
FIG. 11 is a diagram depicting short path circulation processing according to the third embodiment.
Figure 12:
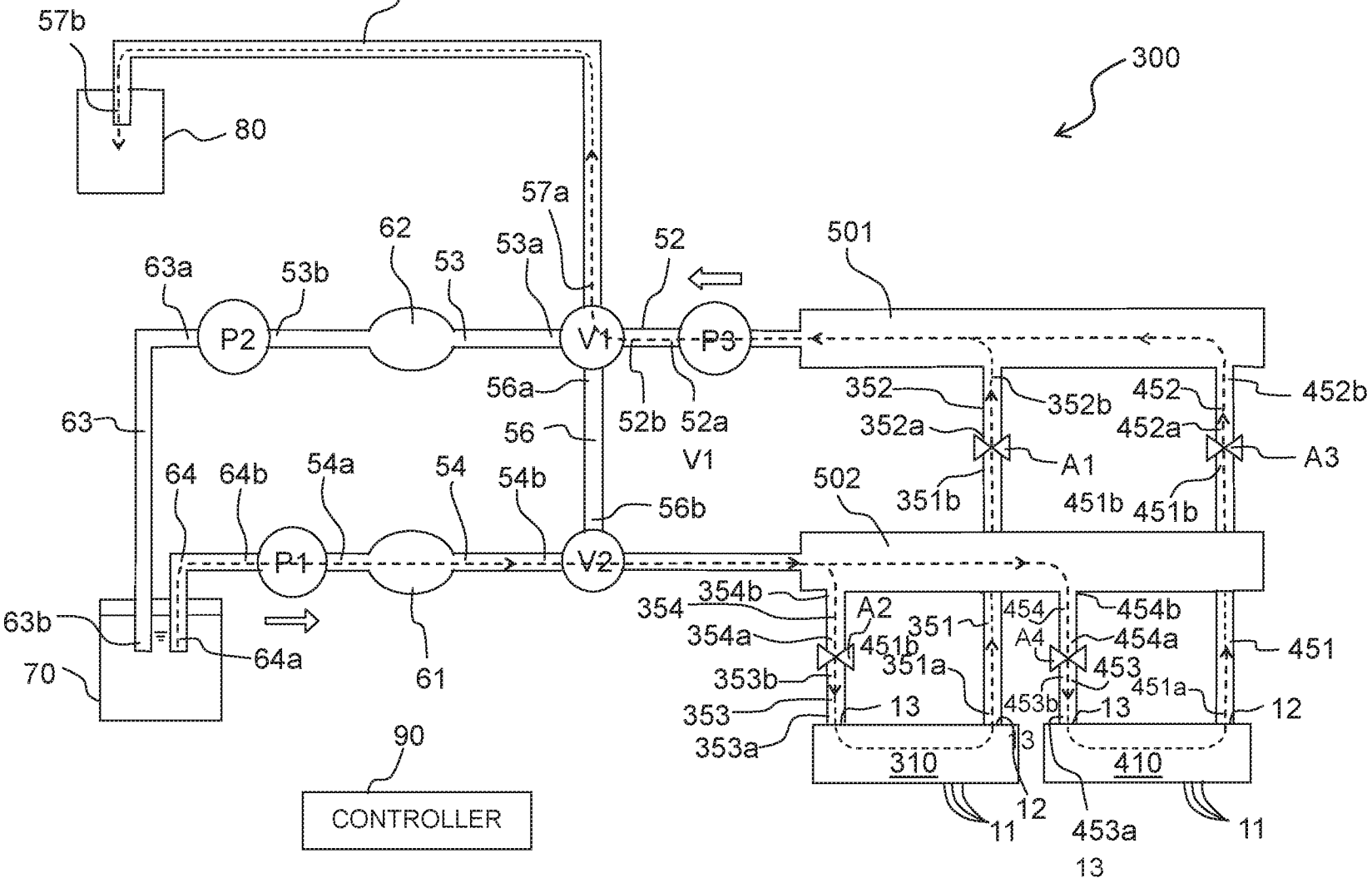
FIG. 12 is a diagram depicting collection processing according to the third embodiment.
Figure 13:
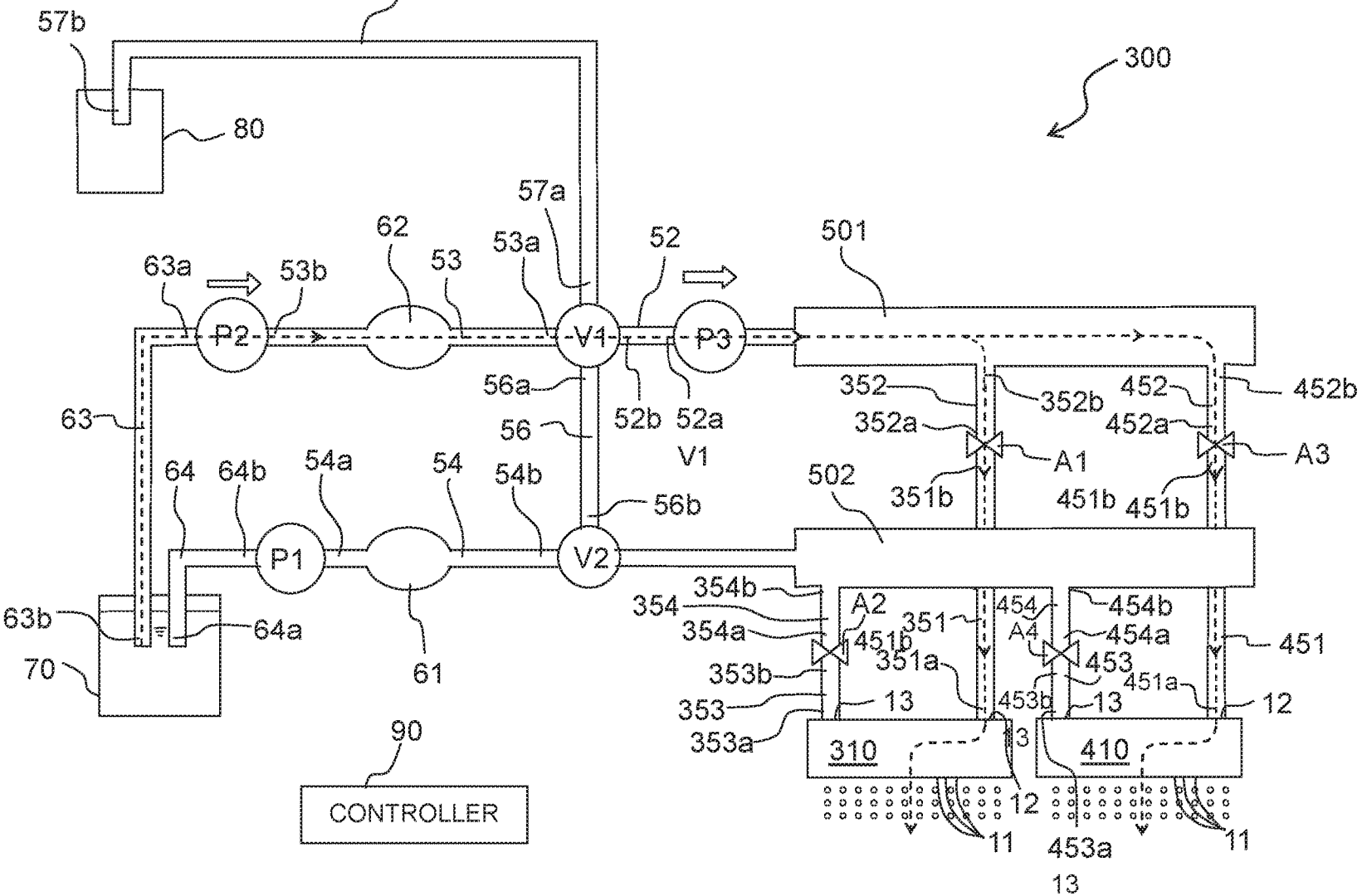
FIG. 13 is a diagram depicting purge processing according to the third embodiment.

The switching valve V1 may be switched to the first state of connecting the channel 52 and the channel 53 (FIG. 10), the second state of connecting the channel 52 and the channel 56 (FIG. 11), and the sixth state of connecting the channel 52 and the channel 57 (FIG. 12). The switching valve V2 may be switched to the third state of connecting the channel 502 and the channel 54 (FIG. 10), the fourth state of connecting the channel 502 and the channel 56 (FIG. 11), and the fifth state of stopping the outflow of an ink from an end of the channel 502 which communicates with the switching valve V2 (FIG. 13).

Each of the opening/closing valves A1 to A4 may be switched to an open state for allowing an ink flow and a closed state for inhibiting an ink flow. When the CPU 91 executes each of the short path circulation processing (S2), collection processing (S3), purge processing (S4), and long path circulation processing (S5), the CPU 91 selects and performs any one of setting the respective opening/closing valves A1 to A4 to be in the open state, setting the opening/closing valves A1, A2 to be in the open state together with setting the opening/closing valves A3, A4 to be in the closed state, and setting the opening/closing valves A1, A2 to be in the closed state together with setting the opening/closing valves A3, A4 to be in the open state. The CPU 91 makes the above-described selection, based on a command from an external device (input by user), the discharging time of each of the heads 310, 410, and so on.

In the short path circulation processing (S2), the CPU 91 first sets the switching valve V1 to be in the second state and sets the switching valve V2 to be in the fourth state, as depicted in FIG. 11. Subsequently, the CPU 91 drives the circulation pump P3 while maintaining the states of the switching valves V1, V2.

If the CPU 91 performs the short path circulation processing (S2) by selecting to set the respective opening/closing valves A1 to A4 to be in the open state, an ink is circulated along the short path (a relatively short annular path not including the sub-tank 70) as depicted in FIG. 11. At this time, a circulation path for the head 310 and a circulation path for the head 410 are formed simultaneously. The circulation path for the head 310 is a path from the circulation pup P3 via the channels 52, 56 to the channel 502, then from the channel 502 via the channels 354, 353 to the common channel 15 of the head 310, and further through the channels 351, 352, 501 back to the circulation pump P3. The circulation path for the head 410 is a path from the circulation pump P3 via the channels 52, 56 to the channel 502, then from the channel 502 via the channels 454, 453 to the common channel 15 of the head 410, and further through the channels 451, 452, 501 back to the circulation pump P3. In this way, the ink is circulated by passing through the common channels 15 of the two heads 310, 410. Note that FIG. 11 shows only an ink flow from the circulation pump P3 toward the channel 52; however, in the same manner as the first embodiment, the direction of the ink flow caused by the driving of the circulation pump P3 may be switched, and an ink flow from the circulation pump P3 toward the channel 501 may also be formed.

If the CPU 91 performs the short path circulation processing (S2) by selecting to set the opening/closing valves A1, A2 to be in the open state and set the opening/closing valves A3, A4 to be in the closed state, the circulation path for the head 310, among the short paths depicted in FIG. 11, is formed, but no circulation path for the head 410 is formed.

Consequently, an ink is circulated by passing through the common channel 15 of the head 310 without passing through the common channel 15 of the head 410.

If the CPU 91 performs the short path circulation processing (S2) by selecting to set the opening/closing valves A1, A2 to be in the closed state and set the opening/closing valves A3, A4 to be in the open state, the circulation path for the head 410, among the short paths depicted in FIG. 11, is formed, but no circulation path for the head 310 is formed. Consequently, an ink is circulated by passing through the common channel 15 of the head 410 without passing through the common channel 15 of the head 310.

In the collection processing (S3), the CPU 91 first sets the switching valve V1 to be in the sixth state and sets the switching valve V2 to be in the third state, as depicted in FIG. 12. Subsequently, the CPU 91 drives the supply pump P1 and the circulation pump P3 while maintaining the states of the switching valves V1, V2.

If the CPU 91 performs the collection processing (S3) by selecting to set the respective opening/closing valves A1 to A4 to be in the open state, there is formed, as depicted in FIG. 12, a flow of the ink which flows from the sub-tank 70 via the channels 64, 54 to the channel 502, then from the channel 502 via individual channels for each of the heads 310, 410 to the channel 501, and further from the channel 501 via the channels 52, 57 to the waste ink tank 80. The ink which is present in the channels 64, 54, 502, the individual channels for each of the heads 310, 410, and the channels 501, 52, 57 at the start of the collection processing (S3) is collected into the waste ink tank 80.

If the CPU 91 performed the collection processing (S3) by selecting to set the opening/closing valves A1, A2 to be in the open state and sets the opening/closing valves A3, A4 to be in the closed state, the path for the head 310, among the paths depicted in FIG. 12, is formed, but no path for the head 410 is formed. Consequently, an ink is directed to the waste ink tank 80 by passing through the common channel 15 of the head 310 without passing through the common channel 15 of the head 410.

If the CPU 91 performed the collection processing (S3) by selecting to set the opening/closing valves A1, A2 to be in the closed state and sets the opening/closing valves A3, A4 to be in the open state, the path for the head 410, among the paths depicted in FIG. 12, is formed, but no path for the head 310 is formed. Consequently, an ink is directed to the waste ink tank 80 by passing through the common channel 15 of the head 410 without passing through the common channel 15 of the head 310.

In the purge processing (S4), the CPU 91 first sets the switching valve V1 to be in the first state and sets the switching valve V2 to be in the fifth state, as depicted in FIG. 13. Subsequently, the CPU 91 drives the return pump P2 and the circulation pump P3 while maintaining the states of the switching valves V1, V2.

If the CPU 91 performs the purge processing (S4) by selecting to set the respective opening/closing valves A1 to A4 to be in the open state, as depicted in FIG. 13, the ink in the sub-tank 70 enters the channel 501 via the channels 63, 53, 52, and is pressure-fed from the channel 501 via individual channels for each of the heads 310, 410 to the common channel 15 of each of the heads 310, 410, and the ink is discharged from all the nozzles 11 of each of the heads 310, 410.

If the CPU 91 performs the purge processing (S4) by selecting to set the opening/closing valves A1, A2 to be in the open state and set the opening/closing valves A3, A4 to be in the closed state, the path for the head 310, among the paths depicted in FIG. 13, is formed, but no path for the head 410 is formed. Consequently, an ink is discharged from all the nozzles 11 of the head 310, but no ink is discharged from any of the nozzles 11 of the head 410.

If the CPU 91 performs the purge processing (S4) by selecting to set the opening/closing valves A1, A2 to be in the closed state and set the opening/closing valves A3, A4 to be in the open state, the path for the head 410, among the paths depicted in FIG. 13, is formed, but no path for the head 310 is formed. Consequently, an ink is discharged from all the nozzles 11 of the head 410, but no ink is discharged from any of the nozzles 11 of the head 310.

Figure 14:
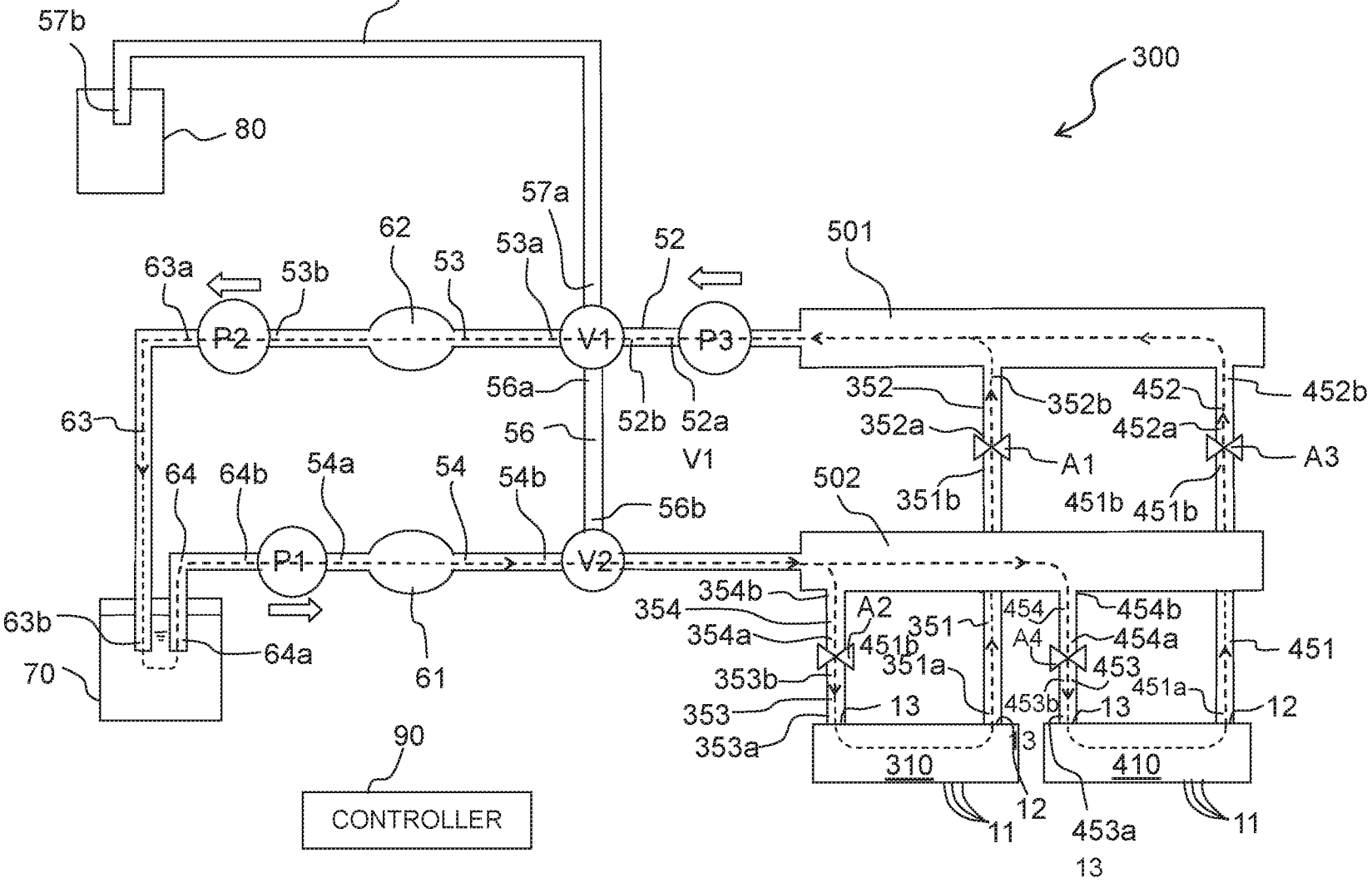
FIG. 14 is a diagram depicting long path circulation processing according to the third embodiment.

In the long path circulation processing (S5), the CPU 91 first sets the switching valve V1 to be in the first state and sets the switching valve V2 to be in the third state, as depicted in FIG. 14. Subsequently, the CPU 91 drives the supply pump P1, the return pump P2 and the circulation pump P3 while maintaining the states of the switching valves V1, V2.

If the CPU 91 performs the long path circulation processing (S5) by selecting to set the respective opening/closing valves A1 to A4 to be in the open state, an ink is circulated along a long path as depicted in FIG. 14 (which is a relatively long annular path including the sub-tank 70, and is a path longer than the short path and larger in volume than the short path). At this time, the circulation path for the head 310 and the circulation path for the head 410 are formed simultaneously. The circulation path for the head 310 is a path from the sub-tank 70 via the channels 64, 54 to the channel 502, then from the channel 502 via the channels 354, 353 to the common channel 15 of the head 310, further via the channels 351, 352 to the channel 501, then from the channel 501 via the channels 52, 53, 63 back to the sub-tank 70. The circulation path for the head 410 is a path from the sub-tank 70 via the channels 64, 54 to the channel 502, then from the channel 502 via the channels 454, 453 to the common channel 15 of the head 410, further via the channels 451, 452 to the channel 501, then from the channel 501 via the channels 52, 53, 63 back to the sub-tank 70. In this way, an ink is circulated by passing through the common channel 15 of each of the two heads 310, 410.

If the CPU 91 performs the long path circulation processing (S5) by selecting to set the opening/closing valves A1, A2 to be in the open state and set the opening/closing valves A3, A4 to be in the closed state, the circulation path for the head 310, among the long paths depicted in FIG. 14, is formed, but no circulation path for the head 410 is formed. Consequently, an ink is circulated by passing through the common channel 15 of the head 310 without passing through the common channel 15 of the head 410.

If the CPU 91 performs the long path circulation processing (S5) by selecting to set the opening/closing valves A1, A2 to be in the closed state and set the opening/closing valves A3, A4 to be in the open state, the circulation path for the head 410, among the long paths depicted in FIG. 14, is formed, but no circulation path for the head 310 is formed. Consequently, an ink is circulated by passing through the common channel 15 of the head 410 without passing through the common channel 15 of the head 310.

As described above, according to this embodiment, the following effects are likely obtained.

The viscosity or the aggregation of components of the ink in the head differs from the head 310 to the head 410. According to the above-described configuration, controls are possible such that circulation processing is performed with respect to a head great in viscosity or aggregation, and that circulation processing is not performed with respect to a head small in viscosity or aggregation. With this, no circulation processing is performed with respect to the head small in viscosity or aggregation, so that an ink discharge amount at the purge processing can be reduced.

In the above, some embodiments of the present disclosure were explained; however, the present disclosure is not limited to the above-described embodiments, and various design alterations are possible. The variations shown below illustrate some design alterations.

Modified Embodiment

The direction of the ink flow in the circulation processing, purge processing, collection processing, and another circulation processing is not particularly limited. For example, the ink flow in the circulation processing and the ink flow in another circulation processing may be mutually the same, or may be opposite to each other. The ink flow in the vicinity of the head in the circulation processing and the ink flow in the vicinity of the head in the purge processing or collection processing may be mutually the same, or may be opposite to each other.

The pump is not limited to a bidirectional pump, and may be a unidirectional pump.

After the circulation processing and prior to the purge processing, no collection processing may be performed.

During the execution of the recording processing, the circulation processing may be performed instead of another circulation processing.

After the power-off duration of the liquid discharge apparatus becomes at least the predetermined period of time, the controller may execute the circulation processing at any timing (for example, on the basis of a command from an external device), without being limited to the time when the power source of the liquid discharge apparatus is turned on.

In the above-described embodiments, during the power-on of the liquid discharge apparatus, a liquid is constantly circulated along the circulation path including the vicinity of the nozzles regardless of whether to execute the recording processing. Consequently, during the power-on of the liquid discharge apparatus, the problem of causing solidification of or plenty of aggregates in the liquid as described above is difficult to occur. From this point, in the above-described embodiments, whether to execute circulation processing is determined on the basis of the power-off duration of the liquid discharge apparatus (see S1 in FIG. 4). On the other hand, in a case that a liquid is not circulated for the period of time when no recording processing is performed (in a stand-by state) during the power-on of the liquid discharge apparatus, whether to execute circulation processing may be determined on the basis of the elapsed time from the point of time of the last stop of circulation to the point of time of the current start of circulation, rather than the power-off duration of the liquid discharge apparatus (namely, if the elapsed time is at least the predetermined period of time, it may be determined to execute circulation processing).

In the third embodiment, at the time of executing each of the short path circulation processing, collection processing, purge processing, and long path circulation processing, the controller is configured to select and perform one of setting the respective opening/closing valves A1 to A4 to be in the open state, setting the opening/closing valves A1, A2 to be in the open state together with setting the opening/closing valves A3, A4 to be in the closed state, and setting the opening/closing valves A1, A2 to be in the closed state together with setting the opening/closing valves A3, A4 to be in the open state. However, the controller may make the above selection when executing the short path circulation procession, and when executing the collection processing, purge processing and long path circulation processing, the controller may maintain the respective opening/closing valves A1 to A4 in the open state without making the above selection. Or, when executing each of the short path circulation processing, collection processing, purge processing and long path circulation processing, the controller may maintain the respective opening/closing valves A1 to A4 in the open state without making the above selection.

The discharging object against which a liquid is discharged is not limited to paper, and may be, for example, cloth, substrates, etc.

The liquid discharged from the nozzles is not limited to an ink, and may be any liquid (for example, a treatment liquid for causing components in an ink to be aggregated or deposited).

The present disclosure is not limited to a printer, and may also be applied to a facsimile machine, copy machine, composite machine, etc. Further, the present disclosure may also be applied to a liquid discharge apparatus used for a purpose other than for recording of an image (for example, a liquid discharge apparatus for discharging a conductive liquid onto a substrate to form a conductive pattern).

What is claimed is:

1. A liquid discharge apparatus, comprising:

a liquid discharge head including:

nozzles;

a first communication port which communicates with the nozzles; and a second communication port which communicates with the nozzles;

a first channel having two ends, one of the two ends communicating with the first communication port;

a pump communicating with the other of the two ends of the first channel;

a second channel having two ends, one of the two ends communicating with the pump;

a first switching valve communicating with the other of the two ends of the second channel;

a third channel having two ends, one of the two ends communicating with the first switching valve;

a storage section configured to store a liquid, and communicating with the other of the two ends of the third channel;

a fourth channel having two ends, one of the two ends communicating with the storage section;

a second switching valve communicating with the other of the two ends of the fourth channel;

a fifth channel having two ends, one of the two ends communicating with the second switching valve and the other of the two ends communicating with the second communication port; and a sixth channel having two ends, one of the two ends communicating with the first switching valve and the other of the two ends communicating with the second switching valve, wherein the first switching valve is switchable to a first state of connecting the second channel and the third channel, and a second state of connecting the second channel and the sixth channel; and the second switching valve is switchable to a third state of connecting the fifth channel and the fourth channel, a fourth state of connecting the fifth channel and the sixth channel.

2. The liquid discharge apparatus according to claim 1, further comprising a controller configured to set the first switching valve to be in the second state and set the second switching valve to be in the fourth state, and then, drive the pump to execute a circulation of the liquid.

3. The liquid discharge apparatus according to claim 2, wherein the second switching valve is switchable to the third state, the fourth state, and a firth state of stopping an outflow of the liquid from the one of the two ends of the fifth channel; and after executing the circulation of the liquid, the controller is configured to set the first switching valve to be in the first state and set the second switching valve to be in the fifth state, and then, drive the pump to execute a purge for discharging the liquid.

4. The liquid discharge apparatus according to claim 3, further comprising:

a collection section configured to collect the liquid; and a seventh channel having one end which communicates with the first switching valve and the other end which communicates with the collection section, wherein the first switching valve is switchable to the first state, the second state, and a sixth state of connecting the second channel and the seventh channel; and after executing circulating the liquid and prior to executing the purge, the controller is configured to set the first switching valve to be in the sixth state and set the second switching valve to be in the third state, and then, drive the pump to collect the liquid from the second channel via the seventh channel into the collection section.

5. The liquid discharge apparatus according to claim 3, wherein the third channel includes:

a seventh channel having two ends, one of the two ends being the one of the two ends of the third channel; and an eighth channel having two ends, one of the two end being the other of the two ends of the third channel;

the liquid discharge apparatus further comprises:

a third switching valve communicating with the other of the two ends of the seventh channel and the other of the two ends of the eighth channel;

a collection section configured to collect the liquid; and a ninth channel having two ends, one of the two ends communicating with the third switching valve and the other of the two ends communicating with the collection section;

the third witching valve is switchable to a sixth state of connecting the seventh channel and the eighth channel, and a seventh state of connecting the seventh channel and the ninth channel; and at the time of executing the purge, the controller is configured to set the first switching valve to be in the first state, set the second switching valve to be in the fifth state and set the third switching valve to be in the sixth state, and then, drive the pump to discharge the liquid from the nozzles, and after executing the circulation of the liquid and prior to executing the purge, the controller is configured to set the first switching valve to be in the first state, set the second switching valve to be in the third state and set the third switching valve to be in the seventh state, and then, drive the pump to collect the liquid from the seventh channel via the ninth channel into the collection section.

6. The liquid discharge apparatus according to claim 3, wherein the controller is configured to execute a recording by causing the liquid to be discharged from the nozzles, based on a recording command, and, during executing the recording, the controller is configured to set the first switching valve to be in the first state and set the second switching valve to be in the third state, and then, drive the pump to execute another circulation of the liquid.

7. The liquid discharge apparatus according to claim 6, wherein the controller is configured to execute the another circulation of the liquid after executing the purge.

8. The liquid discharge apparatus according to claim 6, wherein the controller is configured to execute the circulation of the liquid such that the liquid is circulated at a speed greater than a speed for circulating the liquid in the another circulation of the liquid.

9. The liquid discharge apparatus according to claim 2, wherein the controller is configured to execute the circulation of the liquid in response to the liquid discharge apparatus being powered on after a power-off duration of the liquid discharge apparatus is at least a predetermined period of time.

10. The liquid discharge apparatus according to claim 2, wherein the pump is a bidirectional pump; and the controller is configured to switch a direction of a flow of the liquid caused by driving of the pump at the time of executing the circulation of the liquid.

11. The liquid discharge apparatus according to claim 2, further comprising a damper provided for one of the third channel and the fourth channel.

12. The liquid discharge apparatus according to claim 2, wherein the first channel includes:

a first individual channel having two ends, one of the two ends being the one end of the first channel;

a second individual channel having two ends, one of the two ends communicating with the other of the two ends of the first individual channel; and a first common channel having two ends, one of the two ends communicating with the other end of the second individual channel and the other of the two ends being the other of the two ends of the first channel;

the fifth channel includes:

a third individual channel having two ends, one of the two ends being the other of the two ends of the fifth channel;

a fourth individual channel having two ends, one of the two ends communicating with the other of the two ends of the third individual channel; and a second common channel having two ends, one of the two ends communicating with the other of the two ends of the fourth individual channel, and the other of the two ends being the one of the two ends of the fifth channel;

the liquid discharge apparatus, further comprising:

a liquid discharge head A including:

nozzles A;

a first communication port A communicating with the nozzles A; and a second communication port A communicating with the nozzles A;

a first individual channel A having two ends, one of the two ends communicating with the first communication port A, and a second individual channel A having two ends, one of the two ends communicating with the other of the two ends of the first individual channel A and the other of the two ends communicating with the first common channel;

a third individual channel A having two ends, one of the two ends communicating with the second communication port A, and a fourth individual channel A having two ends, one of the two ends communicating with the other of the two ends of the third individual channel A and the other of the two ends communicating with the second common channel;

a first opening/closing valve communicating with the other of the two ends of the first individual channel and the one of the two ends of the second individual channel;

a second opening/closing valve communicating with the other of the two ends of the third individual channel and the one of the two ends of the fourth individual channel;

a third opening/closing valve communicating with the other of the two ends of the first individual channel A and the one of the two ends of the second individual channel A; and a fourth opening/closing valve communicating with the other of the two ends of the third individual channel A and the one of the two ends of the fourth individual channel A;

the first opening/closing valve, the second opening/closing valve, the third opening/closing valve, and the fourth opening/closing valve are respectively switchable to an open state for allowing a flow of the liquid, and a closed state for inhibiting a flow of the liquid; and at the time of executing the circulation of the liquid, the controller is configured to selectively execute one of:

setting each of the first opening/closing valve, the second opening/closing valve, the third opening/closing valve, and the fourth opening/closing valve to be in the open state;

setting the first opening/closing valve and the second opening/closing valve to be in the open state together with setting the third opening/closing valve and the fourth opening/closing valve to be in the closed state; and setting the first opening/closing valve and the second opening/closing valve to be in the closed state together with setting the third opening/closing valve and the fourth opening/closing valve to be in the open state.

* * * * *